US006539950B1

(12) United States Patent
Gueret

(10) Patent No.: US 6,539,950 B1
(45) Date of Patent: Apr. 1, 2003

(54) PRODUCT APPLICATOR, APPLICATOR SYSTEM, AND METHOD OF APPLICATION FOR EYELASHES

(75) Inventor: Jean-Louis H. Gueret, Paris (FR)

(73) Assignee: L'Oreal S.A., Paris (FR)

( * ) Notice: Subject to any disclaimer, the term of this patent is extended or adjusted under 35 U.S.C. 154(b) by 0 days.

(21) Appl. No.: 09/621,680

(22) Filed: Jul. 21, 2000

(30) Foreign Application Priority Data

Jul. 21, 1999 (FR) ..... 99 09451

(51) Int. Cl.[7] ..... A45D 40/26; A45D 40/24

(52) U.S. Cl. ..... 132/218; 132/317; 132/320

(58) Field of Search ..... 132/218, 320, 132/316, 317; 15/206, 207; 401/122, 129, 126

(56) References Cited

U.S. PATENT DOCUMENTS

| | | | |
|---|---|---|---|
| 155,977 | A | 10/1874 | Rogers |
| 466,496 | A | 1/1892 | Heysinger |
| 791,690 | A | 6/1905 | Grell |
| 1,094,013 | A | 4/1914 | Peterson |
| 1,580,365 | A | 4/1926 | Bechtold |
| 1,670,161 | A | 5/1928 | Meyer |
| 1,780,206 | A | 11/1930 | McKellar |
| 1,829,228 | A | 10/1931 | Lewis |
| 1,892,749 | A | 1/1933 | Philaja |
| 1,963,389 | A | 6/1934 | Vardeman |

(List continued on next page.)

FOREIGN PATENT DOCUMENTS

| | | |
|---|---|---|
| DE | 25 59 273 | 7/1977 |
| EP | 0 038 524 | 10/1981 |
| EP | 0 474 934 | 3/1992 |
| FR | 1 000 173 | 2/1952 |
| FR | 1 068 192 | 6/1954 |
| FR | 1 531 835 | 11/1968 |
| FR | 2 564 712 | 11/1985 |
| FR | 2 748 636 | 11/1997 |
| GB | 2 146 520 | 4/1985 |
| GB | 2 159 699 | 12/1985 |
| JP | 61-64817 | 5/1986 |
| JP | 61-194417 | 12/1986 |
| JP | 7-322915 | 12/1995 |
| JP | 9-108033 | 4/1997 |
| JP | 10-215944 | 8/1998 |
| WO | WO 95/17837 | 7/1995 |
| WO | WO 97/28719 | 8/1997 |

OTHER PUBLICATIONS

English translation of JP 61–194417.
English translation of JP 61–64817.
English language abstract of JP 7–322915.
English language abstract of JP 9–108033.
English language abstract of JP 10–215994.
English language Derwent Abstract of DE 25 59 273.
English language Derwent Abstract of EP 0 038 524.
English language Derwent Abstract of FR 2 748 636.
English language translation of French Patent No. 1 531 835.

*Primary Examiner*—John J. Wilson
*Assistant Examiner*—Robyn Kieu Doan
(74) *Attorney, Agent, or Firm*—Finnegan, Henderson, Farabow, Garrett & Dunner, LLP

(57) ABSTRACT

An applicator, applicator system and method of using an applicator for applying a product to the eyelashes include an application element disposed on an end of a stem. The application element includes at least one row of consecutive teeth alternately disposed at least partially on opposite sides of a geometric separation surface. The consecutive teeth have portions substantially contiguous with one another. Interstices, such as V-shaped notches, are defined by consecutive teeth above the substantially contiguous portions. Three consecutive teeth define a volume configured to contain the product to be applied.

224 Claims, 11 Drawing Sheets

U.S. PATENT DOCUMENTS

| | | | |
|---|---|---|---|
| 1,989,185 | A | 1/1935 | Clein |
| 2,077,245 | A | 4/1937 | Locke |
| 2,175,344 | A | 10/1939 | Friedman |
| 2,255,618 | A | 9/1941 | Huppert |
| 2,264,346 | A | 12/1941 | Tupper |
| 2,348,339 | A | 5/1944 | Golden |
| 2,395,002 | A | 2/1946 | Kemmer |
| 2,569,246 | A | 9/1951 | Marcellus |
| 2,596,296 | A | 5/1952 | Shields |
| 2,626,618 | A | 1/1953 | Collison |
| 2,655,925 | A | 10/1953 | Ulvad |
| 2,922,425 | A | 1/1960 | Lerner et al. |
| 3,033,213 | A | 5/1962 | Joss et al. |
| 3,312,583 | A | 4/1967 | Rochlis |
| 3,669,130 | A | 6/1972 | Petroczky |
| 3,763,870 | A | 10/1973 | Montgomery et al. |
| 3,862,639 | A | 1/1975 | Schefer et al. |
| 3,892,248 | A | 7/1975 | Kingsford |
| 3,896,823 | A | 7/1975 | Spatz |
| 3,921,650 | A | 11/1975 | Montgomery |
| 3,930,280 | A | 1/1976 | Vasas |
| 4,403,624 | A | 9/1983 | Montgomery |
| 4,422,986 | A | 12/1983 | Cole |
| 4,561,456 | A | 12/1985 | Gueret |
| 4,565,205 | A | 1/1986 | Taylor |
| 4,635,659 | A | 1/1987 | Spatz |
| 4,660,582 | A | 4/1987 | Taylor |
| 4,712,936 | A | 12/1987 | Kessler |
| 4,744,377 | A | 5/1988 | Dolan, Jr. |
| 4,804,004 | A | 2/1989 | Taylor |
| 5,007,442 | A | 4/1991 | Hirzel |
| 5,046,213 | A | 9/1991 | Curtis et al. |
| 5,086,793 | A | 2/1992 | Kingsford |
| 5,137,387 | A | 8/1992 | Byrd et al. |
| 5,765,573 | A | 6/1998 | Gueret |
| 5,918,994 | A | 7/1999 | Gueret |
| 5,951,185 | A | 9/1999 | Kingsford et al. |
| 6,053,179 | A | 4/2000 | Lhuisset |
| 6,076,531 | A | 6/2000 | Gueret |

PRODUCT APPLICATOR, APPLICATOR SYSTEM, AND METHOD OF APPLICATION FOR EYELASHES

The present invention pertains to applicators, and methods of using such applicators, for applying a product. In particular, the present invention is directed toward an applicator for the application of a product, such as a cosmetic product for example, to the eyelashes or eyebrows. The invention also relates to an applicator system including the applicator and a container for containing the product to be applied. Applicators including a comb having a single row of teeth aligned along a straight line have been used to apply a make-up product. Spaces between the teeth may be filled with product when the applicator is extracted from the container.

In order to form product reservoirs which permit such a conventional applicator to be used without having to reload the makeup product onto the applicator too frequently, the teeth typically are fairly widely spaced from one another. The spacing between two consecutive teeth generally is significantly greater than the diameter of an eyelash. This configuration has the drawback of not allowing the eyelashes to be gripped by the comb very well. Thus, these conventional applicators are not able to properly smooth the product deposited at the surface of the lashes and are not capable of satisfactorily lengthening and curling the eyelashes. Moreover, these conventional comb-like applicators often are not suitable for applying pasty or relatively low viscosity products.

Application DE-A-25 59 273 discloses a brush comprising rows of bristles connected to a support. The bristles of each row have fairly widely spaced portions connected to the support and located alternately on each side of a central line.

Application EP-A-0 474 934 discloses a brush including a number of rows of elements oriented radially, said rows being axially offset with respect to each other.

In one aspect of the present invention, an applicator is provided for applying a product, for example a make-up product to the eyelashes, which is capable of satisfactorily gripping the eyelashes while at the same time holding fairly large reservoirs of product on the applicator. Another aspect of the invention includes providing an applicator capable of applying a product containing fibers such that the applicator orients the fibers substantially parallel to the eyelashes as the product is applied.

Preferably, these aspects are achieved by an applicator having an application element including at least one row of consecutive teeth disposed alternately at least partially on opposite sides of a geometric separation surface. At least two consecutive teeth, and preferably a plurality of consecutive teeth, have portions substantially contiguous with one another. As described in more detail below, the alternate disposition of consecutive teeth on opposite sides of a geometric separation surface preferably provides one or more product reservoirs defined by groups of consecutive teeth.

The expression "substantially contiguous portions" as used throughout the specification and claims should be understood as meaning that an eyelash inserted between the consecutive teeth in a plane substantially perpendicular to a longitudinal axis of the application element is prevented from moving freely between the portions due to the proximity of the portions to one another. In other words, when the application element is placed in contact with the eyelashes such that it extends substantially transversely to the eyelashes, an eyelash entering between consecutive teeth having portions substantially contiguous with one another will be prevented from moving freely between the portions and gripped due to the proximity of the portions to one another. The gripping of the substantially contiguous portions could occur at any position along the length of the consecutive teeth. In addition, the substantially contiguous portions can be close enough to one another so that passage of an eyelash between parts of the consecutive teeth is prevented. Although "substantially contiguous portions" encompasses portions contacting or overlapping with one another, "substantially contiguous portions" are not required to contact one another as long as an eyelash is prevented from moving freely between the portions. The exact dimensions for the substantially contiguous spacing could be selected based on a number of factors, such as the average diameter of eyelashes and the particular type of product being applied.

As mentioned above, the substantially contiguous portions provide a gripping of an eyelash. This gripping allows a product to be spread in a substantially uniform manner along substantially the entire length of an eyelash. When the applicator is used to apply mascara, such substantially uniform application along substantially the entire length of the eyelashes makes the eyelashes appear to be lengthened. The gripping of the eyelashes by the substantially contiguous portions also allows the eyelashes to be rearranged by moving the applicator. For example, when the eyelashes are gripped, rotation of the applicator could provide corresponding curling of the gripped lashes.

In one embodiment, the at least two consecutive teeth have substantially contiguous roots. The roots also may be contacting or overlapping. In another embodiment, the at least two consecutive teeth have portions, which may be upper portions, contacting one another. In yet another embodiment, the at least two consecutive teeth have overlapping portions. A plurality of consecutive teeth also may have substantially contiguous portions.

The expression "overlapping portions" as used herein should be understood as meaning portions covering one another when the application element is observed from the side or face-on, or which, at a minimum, cover one another only via an edge or point of contact.

One aspect of the invention includes two adjacent teeth offset on the same side of the geometric separation surface being spaced apart without touching one another.

Unlike the brush described in application DE-A-25 59 273 having relatively widely spaced bristles that do not prevent the eyelashes from freely moving between the bristles, in one aspect of the present invention, the eyelash preferably engages in an interstice essentially in the form of a notch formed between the at least two consecutive teeth and is gripped between these two teeth. The eyelash may even be prevented from passing entirely between the teeth forming the notch and reaching a base portion which the teeth may be disposed on. The eyelash becomes firmly gripped by the teeth because of the substantially contiguous portions and the applicator may be able to lengthen the eyelash and smooth the product thereon achieving an overall improved make-up effect.

In addition, unlike the brush described in application EP-A-0 474 934, in the another aspect of the present invention, portions of three consecutive teeth in the row of consecutive teeth preferably define at least part of a volume configured to contain the product.

Thus, the applicator of the invention is preferably capable of both containing an amount of product sufficient for application without the need to reload too frequently and of firmly gripping the eyelashes to promote lengthening, curling, and spreading the product thereon.

Furthermore, by altering the geometry of the teeth and their configuration, it is easily possible to form volumes containing either more or less product between the teeth, as may be desired.

The spacing between two adjacent teeth on one side of the geometric separation surface may, for example, be greater than or equal to half the width of the tooth offset on the other side of the geometric separation surface. Thus, it may be possible to hold a substantial amount of product between the teeth.

In an embodiment according to the invention, at least two consecutive teeth have overlapping faces extending in a direction parallel to a length of the application element. This may include roots of the teeth overlapping when the application element is observed from the side.

According to another aspect of the invention, at least one interstice is formed between two consecutive teeth. Preferably the interstices include notches each having a substantially V-shaped configuration. The bottoms of the notches defined between the at least two consecutive teeth are located above the substantially contiguous portions. Preferably, the teeth are disposed on a base portion and the bottom of the notch is located at a distance above the base portion, preferably a distance greater than or equal to approximately 0.2 mm from the top of the base portion.

The teeth disposed on one side of the geometric separation surface preferably are at different axial positions along the length of the application element than the teeth disposed on the other side of the geometric separation surface.

In another aspect of the invention, three consecutive alternately disposed teeth define a volume configured to contain the product, which is preferably mascara. This volume includes a substantially open portion and a substantially closed portion. The substantially open portion is defined between two of the three consecutive teeth disposed on the same side of the geometric separation surface and the substantially closed portion is defined by one of the three consecutive teeth disposed on the opposite side of the geometric separation surface from the two of the three consecutive teeth disposed on the same side. The substantially open portion and the substantially closed portion preferably face in a direction away from the geometric separation surface and may extend parallel to the geometric separation surface. Moreover, the geometric separation surface may be between the substantially closed portion and the substantially open portion. A base portion on which the teeth are disposed may further define the volume. The application element may include a plurality of volumes defined by three consecutive teeth.

Another aspect of the invention includes an application element disposed on the end of a stem. The application element includes at least one row of consecutive teeth alternately disposed at least partially on opposite sides of a geometric separation surface. The consecutive teeth include roots and a cross-section of each of the roots of teeth located on one side of the geometric separation surface has one of a face and a tangent plane facing toward a portion of the application element located on an opposite side of the geometric separation surface. The face or tangent plane is substantially parallel to a longitudinal axis of the application element. At least two consecutive teeth in the row have portions substantially contiguous with one another. The cross section of the roots may be polygonal and a face of each of the roots may face the portion of the application element located on the opposite side of the geometric separation surface and may be substantially parallel to the longitudinal axis of the application element. Alternatively, the cross-section may be at least partly non-polygonal along an inner part of the roots. In this case, a tangent plane along each inner part faces the portion of the application element and is substantially parallel to the longitudinal axis.

The teeth may have roots having a larger depth than width. This permits the teeth to have greater resistance to forces exerted transversely on the application element. The depth of the tooth is measured in a direction perpendicular to a longitudinal axis of the application element while the width is measured parallel to the longitudinal axis.

Preferably, the teeth have a depth larger than the gap separating two adjacent teeth offset to the same side of the geometric separation surface.

Preferably, a ratio b/e is greater than or equal to approximately 1.2, and more preferably the ratio is greater than or equal to approximately 1.4, where b is the depth of the root of a tooth and e is the width.

Also preferably, the ratio b/c is greater than or equal to approximately 1.2, and more preferably greater than or equal to approximately 1.4, where b is the depth of the root of a tooth and c is the gap separating two adjacent teeth offset the same side of the geometric separation surface.

The teeth may have a depth varying along the length of application element or base portion. Thus, the depth of the teeth may increase, decrease, increase then decrease, or vice versa, along the length of the application element.

A ratio of the spacing between two teeth on the same side of the separation surface and the width of a tooth on the opposite side of the separation surface disposed intermediate the two teeth may range from approximately 0.2 to approximately 2.0, as measured at approximately the midportion of the height of the teeth.

As a preference, the teeth are molded as a single piece with the base portion. Preferably, the teeth and base portion are molded using plastic.

The application element may include a part allowing it to be removably connected to the applicator stem. As an alternative, the application element may be produced by molding plastic as a single piece with the applicator stem. The application element preferably has two substantially opposite ends and a portion located between the ends. One of the substantially opposite ends of the application element can be connected to a distal end portion of the stem, and a longitudinal axis of the application element may extend either at an angle to or substantially parallel to a longitudinal axis of the stem. Alternatively, the portion of the application element located between the two substantially opposite ends may be connected to a distal end portion of the stem, and the longitudinal axis of the application element may be substantially perpendicular to the longitudinal axis of the stem. The stem may be substantially flat.

The stem may include a connector at a distal end portion and the application element may be engageable with the connector. Preferably, the connector defines a slot configured to receive the application element.

The application element may be produced by molding plastic as a single piece with the applicator stem and with a sealing member intended to seal the container closed when it is not in use, it being possible for this sealing member to have a surface shaped to fit in sealed manner into the neck of the container. The applicator may also include a cap disposed on an end of the applicator stem opposite to the end on which the application element is disposed. This cap may include a sealing member and be configured to sealably close an opening in the container.

According to one aspect of the invention, the application element is made of a material more flexible than a material used to make the applicator wand. As an alternative, the stem may be made of a material more flexible than the material used to make the application element. It is thus possible, for manufacturing reasons, to use a relatively inflexible material to make the application element and to compensate for the inflexibility of the application element at the time of application with the flexibility of the stem. The application element may be made of a material having a greater flexibility than the material used to make the stem, thus giving greater comfort in use. Preferably, both the stem and the application element are made of plastic materials.

The application element may include two parts connected together via a film hinge. A series of teeth may be disposed on upper surfaces of each of the two parts and the two parts may be folded together at the film hinge. By folding the two parts together, the upper surfaces of the two parts oppose each other and the series of teeth on each part come together to form the row of alternately disposed consecutive teeth of the application element.

The height of the teeth may vary along the length of the application element. As a preference, the height of the teeth ranges from approximately 0.5 mm to approximately 15 mm. More preferably, the height of the teeth ranges from approximately 7 mm to approximately 13 mm.

In one embodiment, the height of the teeth is on the order of 3 mm and the bottom of the notches formed between consecutive teeth is at a distance d of about 2 mm from the base portion.

The geometric separation surface may be a plane, and preferably a mid-plane of the application element or base portion. Moreover, the geometric separation surface preferably is a parting line for the molding for the row of teeth, more preferably for the molding of the application element or base portion.

The geometric separation surface alternatively may be a cylindrical surface, the directrix of which is a curve or a broken line. The geometric separation surface also may be non-planar, for example twisted. The geometric separation surface may thus be a helical surface, for example.

In one embodiment of the invention, at least one groove is formed between the roots of adjacent teeth disposed at least partially on the same side of the geometric separation surface. The base portion may have two substantially opposite facing sides with the consecutive teeth being disposed alternately on the substantially opposite facing sides. The groove may be formed on one side of the base portion between adjacent teeth disposed on the one side. Preferably, the groove is in product flow communication with a volume defined by the two adjacent teeth and a third tooth disposed on the opposite facing side of the base portion or the geometric separation surface and located intermediate the two adjacent teeth.

A plurality of grooves may be formed between adjacent teeth on either side of the geometric separation surface. The plurality of grooves may also be formed on the opposite sides of the base portion.

At least one tooth may have at least one face facing toward an end of the application element, the at least one face being disposed at an angle to a longitudinal axis of the application element when the application element is viewed from the side. The angle can be either acute to, obtuse to, or perpendicular to the longitudinal axis The roots of the teeth may have front and/or rear faces facing the ends of the application element perpendicular to the axis of the base portion or forming an acute or obtuse angle therewith.

The roots of the teeth may have a longitudinal axis disposed at an angle, chosen from perpendicular, acute, and obtuse, relative to the longitudinal axis of the application element. If the teeth are disposed on a base portion, the roots may be at an angle to the longitudinal axis of the base portion.

In one aspect of the invention, the row of teeth includes a first series of teeth having front and/or rear faces inclined with respect to the longitudinal axis of the application element, and a second series of teeth having front and/or rear faces inclined in a different way than the teeth of the first series with respect to the axis of the application element. The teeth of the first series and those of the second series are arranged alternately at least partially on each side of a geometric separation surface. As used herein, front faces are those faces facing a distal end of the applicator, whereas rear faces are those faces facing a proximal end of the applicator.

Preferably, at least one face of a tooth disposed on one side of the geometric separation surface facing toward an end of the application element is disposed at an angle different from that of at least one face of a tooth disposed on the opposite side of the geometric separation surface. For example, one of the two consecutive teeth may have at least one face facing an end of the application element inclined with respect to a longitudinal axis of the application element, and the other of the two consecutive teeth may have at least one face facing an end of the application element inclined in a different way than the first consecutive tooth.

The teeth may include an upper portion coaxial with the root. The upper portions of the teeth may alternately be oriented forward and backward respectively, that is toward first and second opposite ends of the application element.

The teeth also may include upper portions, especially free ends, oriented either outward, i.e., away each other, or inward, i.e., toward each other, when the application element is viewed from the front.

The two consecutive teeth may have overlapping faces extending in a direction parallel to a length of the application element. Alternatively, two consecutive teeth may have overlapping faces extending in a direction perpendicular to a length of the application element. Preferably the faces are on roots of the teeth.

At least one of the consecutive teeth of the application element has at least one of a convex, a concave, and a planar face facing an end of the application element. The faces of the teeth disposed on one side of the geometric separation surface may differ in configuration from the faces of the teeth disposed on the opposite side of the geometric separation surface.

The application element may include a first series of teeth located on one side of a geometric separation surface and a second series of teeth located on the other side of the geometric separation surface alternating with the teeth of the first series. The teeth of either or both series may have either convex or concave faces facing either or both ends of the application element. The faces of both series need not have the same configuration, nor do the faces of the teeth within a series need to have the same configuration.

The application element may include a first series of teeth located on one side of a geometric separation surface and a second series of teeth located on the other side of this geometric separation surface alternating with the teeth of the first series. The teeth of the first series may have either a concave or convex face facing either or both ends of the application element, while the teeth of the second series having a planar face facing either or both ends of the application element.

In one embodiment, when the application element is observed along its longitudinal axis, i.e., from the front, two consecutive teeth have diverging free ends. As an alternative, when the application element is observed along its axis, at least two consecutive teeth have converging free ends. In yet another alternative, when the application element is observed along its axis, at least two consecutive teeth have free ends which cross or are substantially parallel. Thus, the free ends may point in the same direction. When the application element is observed along its axis, at least two consecutive teeth may have substantially aligned free ends, and preferably three consecutive teeth have substantially aligned free ends.

The base portion of the application element may have a polygonal or non-polygonal (for example, circular or elliptical) cross section, and the application element may include at least one row of teeth extending substantially in the continuation of a side of the base, when the base has a polygonal section, or the teeth may connect to the base substantially at a tangent, when the base has a non-polygonal section. An application element configured in this manner allows the base to be used to apply the product and cause gradual contact between the eyelashes and the teeth. Such an application element may promote curling of the lashes. Preferably, a plurality of rows of teeth are disposed on the base portion, each extending in continuation of a different side or connected substantially at a tangent at different angular locations.

The row of teeth also may extend substantially radially from the base portion. Moreover, a plurality of rows may be disposed on the base portion at different angular positions around a perimeter of the base portion, essentially forming a brush.

The inventive applicator described above may be used in conjunction with a container containing the product. Preferably, the container has a wiper configured to remove excess product from the teeth of the application element when the applicator is removed from the container. This wiper is preferably deformable, and may include, for example, a block of foam or an elastomeric lip.

A further aspect of the invention includes an applicator, applicator system, or method of application, as discussed above, wherein the product to be applied to eyelashes is a cosmetic product, preferably mascara. The mascara may contain fibers that become oriented by the application element so as to be parallel to the eyelashes during application of the mascara.

Other aspects of the invention include a method for applying a product to eyelashes comprising providing either the systems or applicators described above, loading a product on at least some of the teeth of the applicator, and placing at least some of the teeth in contact with the eyelashes such that the product coats the eyelashes. The loading may include inserting the applicator into a container containing the product and removing the applicator from the container and wiping excess product from the teeth. Alternatively, the loading may include dispensing the product from the container onto the teeth or contacting the teeth with a solid cake of product. Preferably, the latter type of loading also includes moistening the solid cake of product. The moistening may include moistening the teeth. The method also includes gripping the eyelashes between adjacent teeth.

Another aspect of the method according to the invention includes connecting an application element to a stem, the teeth being disposed on the application element. Prior to connecting the application element, one of a plurality of application elements having teeth with various configurations may be selected to connect to the stem.

Preferably, the applicators, systems and methods of the present invention are used to apply a cosmetic product, for example, mascara, to the eyelashes, however other products also could be used and be applied to other surfaces.

Aside from the structural and procedural arrangements set forth above, the invention could include a number of other arrangements, such as those explained hereinafter. It is to be understood that both the foregoing description and the following description are exemplary, and are intended to provide further explanation of the invention as claimed.

The accompanying drawings are included to provide a further understanding of the invention and are incorporated in and constitute a part of this specification. The drawings illustrate embodiments of the invention and, together with the description, serve to explain the principles of the invention. In the drawings, FIG. 1 is an axial cross-sectional view of an applicator inserted into a container containing a product to be applied according to an aspect of the invention;

Figure 1A:
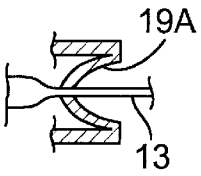
FIG. 1A is a partial cross-sectional view of an applicator system wherein the wiper is in the form of an elastomeric lip according to an aspect of the invention.
Figure 1:
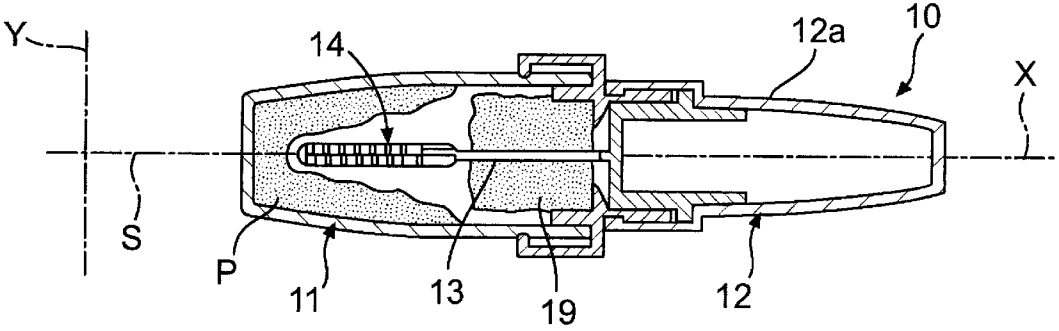

The applicator system 10 shown in FIG. 1 includes a container 11 containing a product P, for example a mascara of fluid to pasty consistency, and an applicator 12 comprising a stem 13 of axis X equipped at one end with an application element 14 and equipped at the other end with a handling member 12*a* for grasping. The handling member 12*a* may be in the form of a cap for closing the container 11.

The container 11 includes a wiper, or wringing-out member, 19. Wiper 19 may include a block of open-cell foam, as shown in FIG. 1, or an elastomeric lip 19A, as shown in FIG. 1A. This lip may or may not be flocked. In either case, the wiper preferably is deformable so that it conforms to the shape of the application element. The application element shown is essentially in the form of a comb 14 located in the continuation of the applicator stem 13. That is, a longitudinal axis of the application element 14 in FIG. 1 is substantially parallel to the longitudinal axis of the stem 13 and the end of the application element 14 is connected to the end of the stem 13. As will be explained, the longitudinal axis of the stem and the application element need not be parallel to one another.

Over part of its length, the stem 13 preferably has a smaller diameter than the application element 14, so as not to compress the wiper 19 excessively.

Figure 2:
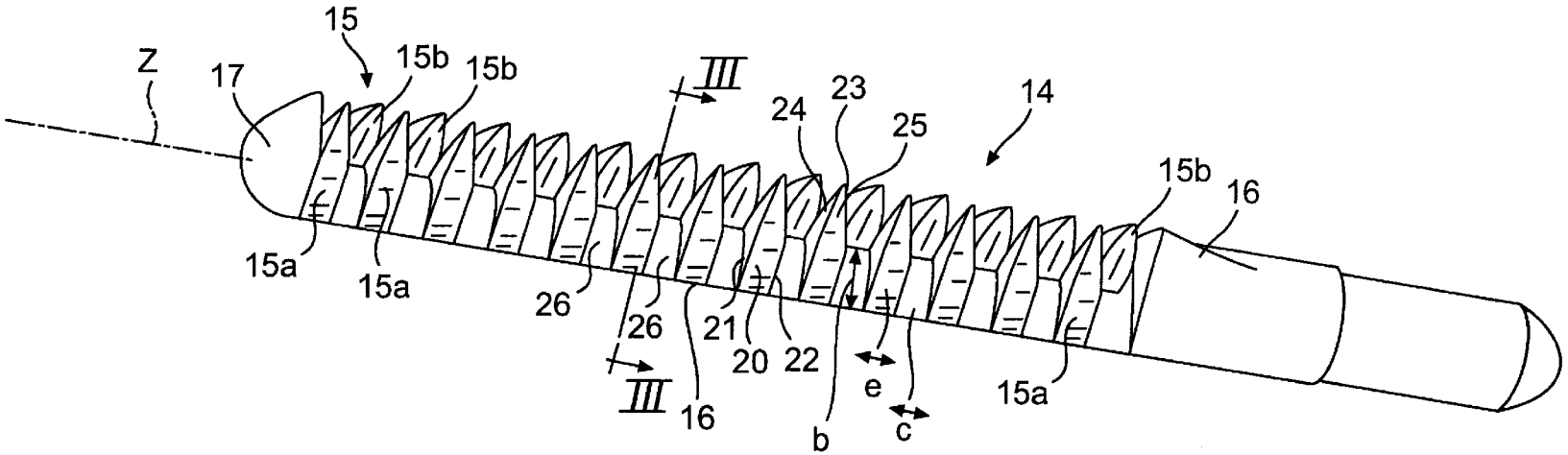
FIG. 2 is a perspective view of an application element of the applicator according to an aspect of the present invention.

The application element 14 is shown in more detail in FIG. 2. This application element 14 includes a row 15 of consecutive teeth comprising a first series of teeth 15*a* and a second series of teeth 15*b*, disposed alternately on opposite sides of a geometric separation surface S. Although in FIG. 2 each tooth in the series of the consecutive teeth is disposed entirely on a respective side of the geometric separation surface, only parts of the consecutive teeth can be disposed alternately on opposite sides of the separation surface without departing from the scope of the invention.

The teeth 15*a* and 15*b* are connected to a base portion 16 having longitudinal axis Z. The geometric separation surface S shown is a mid-plane of symmetry for the base 16 portion and is also a parting line for molding the application element.

Figure 3:
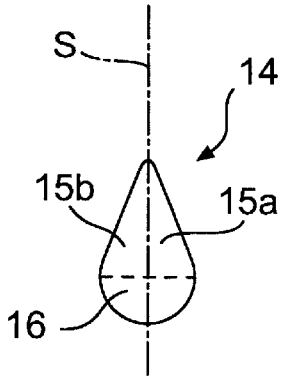
FIG. 3 is a cross-sectional view in the direction of arrow III of the application element of FIG. 2 showing the tear drop shaped outer peripheral surface of the application element.

As can be seen in FIG. 3, the outer surface of the base portion 16 is substantially a cylinder of semicircular cross section and the envelope or outer periphery of the row 15 of teeth forms a cylinder of substantially triangular cross section. Overall, then, the crosssectional configuration of the outer peripheral surface of the application element formed by the teeth and base portion is essentially a tear drop shape in the embodiment shown in FIG. 2.

The application element 14 preferably is provided with a rounded tip 17 at its front (i.e., distal) end to make it easier for the applicator to be inserted into the container 11. At its rear (i.e, proximal) end, the application element 14 preferably has a boss 18 intended to ease the passage of the application element through the wiper 19.

As can be seen in FIG. 2, the depth b of the teeth 15*a* and 15*b* at the point where they connect to the base portion 16 is, in the embodiment shown, greater than their width e and also greater than the gap c between two consecutive teeth 15*a* or 15*b*. The depth is measured perpendicular to the longitudinal axis Z and the width is measured parallel to the longitudinal axis Z. The gap c separating two adjacent teeth 15*a* or 15*b* on the same side of the geometric separation surface is measured parallel to the axis Z of the base portion 16.

Figure 26:
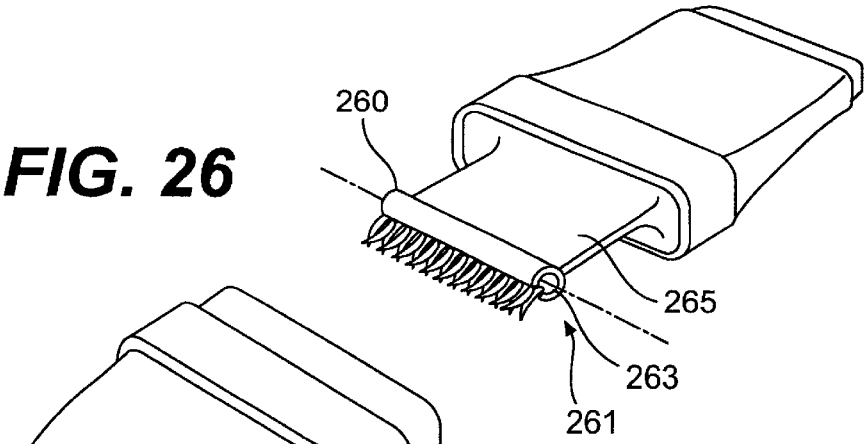
FIG. 26 is a perspective view of an applicator having an application element with a longitudinal axis directed perpendicularly to a longitudinal axis of the applicator stem and wherein the application element is insertable into a housing formed at a distal end portion of the applicator stem according to an aspect of the invention.
Figure 27:
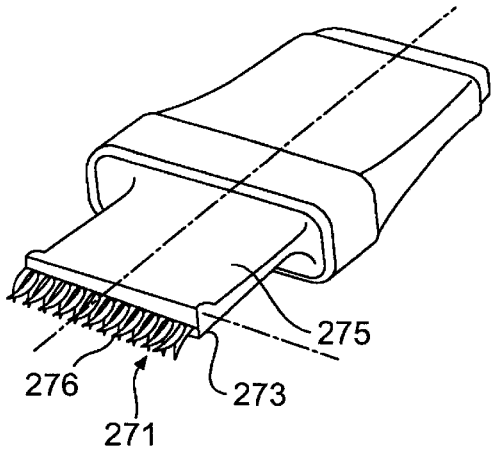
FIG. 27 is a perspective view of an applicator device similar to the one shown in FIG. 26 except wherein the application element is formed as a single piece construction with the stem according to an aspect of the present invention.

The axis Z of the base portion 16 may also be disposed at an angle with the axis X of the applicator stem 13. In fact, as shown in FIGS. 26 and 27, the application element may be connected to the stem at a portion located between the two opposite ends of the application element. Thus, the longitudinal axis of the application element may extend substantially perpendicular to the longitudinal axis of the stem.

By virtue of their widened root, the teeth are capable of withstanding a strain exerted transversely to the axis Z, which allows the eyelashes to be separated and the product deposited at their surface to be smoothed out even when the product used has partially dried.

In FIG. 2, each tooth 15*a* or 15*b* has a lower portion 20 with substantially planar and parallel front 21 and rear 22 faces perpendicular to the axis Z. The upper portions 23 of the teeth have front 24 and rear 25 faces converging toward the free end of the tooth. Thus, the upper portion 23 of each tooth has a tapered overall shape when the application element is observed from the side.

The terms front and rear are used here to denote those faces facing respectively toward the tip 17 of the comb 14 or toward the stem 13 of the applicator 12, i.e., toward the two opposite ends of the application element 14—respectively the distal and proximal ends.

Three consecutive teeth of the row 15 define between them and with the base portion 16 a volume 26 which may contain some product to be deposited on the eyelashes.

Figure 4:
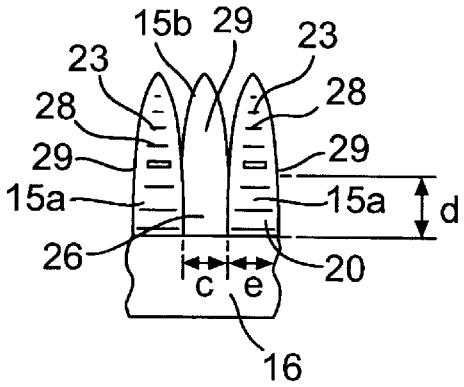
FIG. 4 is a partial side view of the application element of FIG. 2.

Interstices are formed between consecutive teeth when the application element is observed from the side as in FIG. 4. In general, these interstices could be essentially in the form of notches 28 disposed above the substantially contiguous portions of two consecutive teeth. The notches are configured to grip the lashes, separate them, comb them and smooth out the product deposited at their surface.

More specifically, the upper portions 23 of the teeth form between them, when the comb is observed from the side, V-shaped notches 28. The bottoms 29 of the notches preferably are a distance d from the top of the base portion 16, the distance d preferably being greater than or equal to approximately 0.2 mm. In the embodiment shown, the distance d is on the order of 2 mm and the total height of the teeth is on the order of 3 mm.

It should be understood that by altering the height of the teeth, the distance d and the gap c between adjacent teeth on the same side of the geometric separation surface, it may be possible to alter the amount of product with which the comb becomes laden.

The lower portions 20, essentially the roots, of two consecutive teeth overlap slightly when the application element 14 is viewed from the side.

Figure 5:
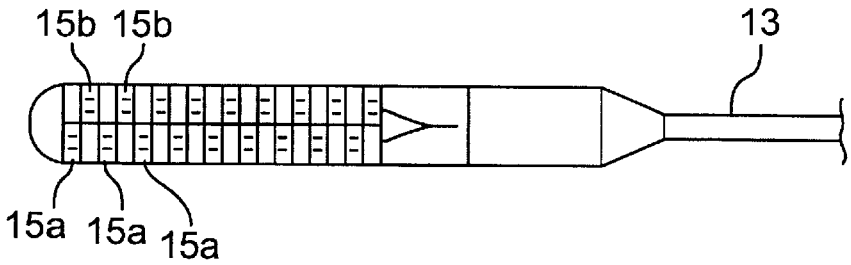
FIG. 5 is a partial top view of the applicator according to the present invention prior to the application element being filled with product in the volumes formed between the teeth.
Figure 6:
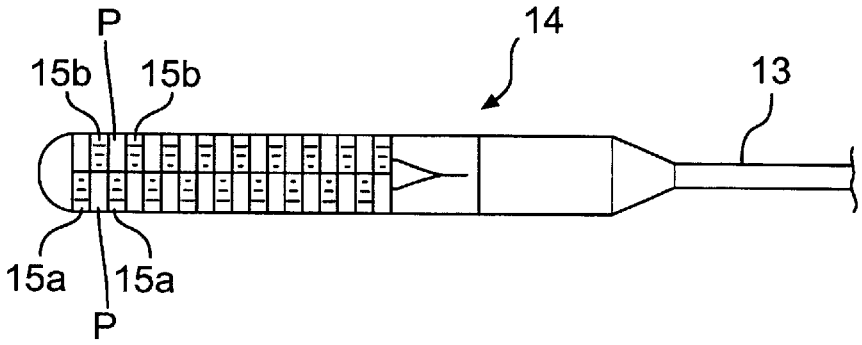
FIG. 6 is a partial top view of the applicator according to the present invention after the application element has been filled with product in the volumes formed between the teeth.

FIGS. 5 and 6 depict the application element 14 respectively before and after it has been laden with product P between the teeth.

It will be understood that the gap c between the teeth of one and the same series of teeth 15*a* or 15*b* can be relatively large, to increase the amount of product held by the application element, without decreasing the ability of the application element to grip the lashes. This is because of the alternating offset of the consecutive teeth and the fact that the notches 28 formed by the upper portions of the teeth, as a result of the substantially contiguous portions of the consecutive teeth, remain sufficiently narrow at the bottoms to grip the lashes.

The teeth of the comb may have numerous configurations without departing from the scope of the present invention.

By way of example, a number of possible configurations have been illustrated in FIGS. 7–12. These figures are merely examples of various configurations of the teeth, and other configurations also are contemplated as within the scope of the invention.

Each of FIGS. 7–12 show two consecutive teeth 30*a* and 30*b* offset alternately on opposite sides of a geometric separation surface S containing the axis Z of the base portion. The teeth have respective lower portions, or roots, 31*a* and 31*b*, and respective upper portions, or free ends, 32*a* and 32*b*.

Figure 7:
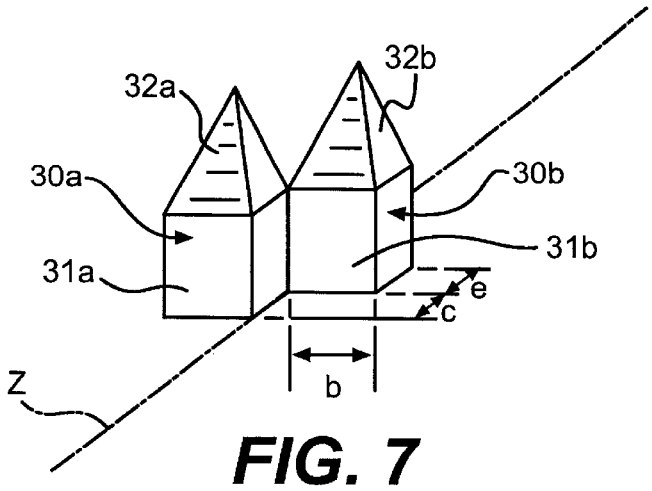
FIG. 7 is a perspective view of two consecutive teeth having free ends extending substantially parallel to each other according to an aspect of the invention.

In FIG. 7, the upper portions 32*a* and 32*b* extend substantially parallel to one another. Furthermore, the upper portions 32*a* and 32*b* have the same axis as the roots 31*a* and 31*b* and the roots 31*a* and 31*b* have a common edge.

Figure 8:
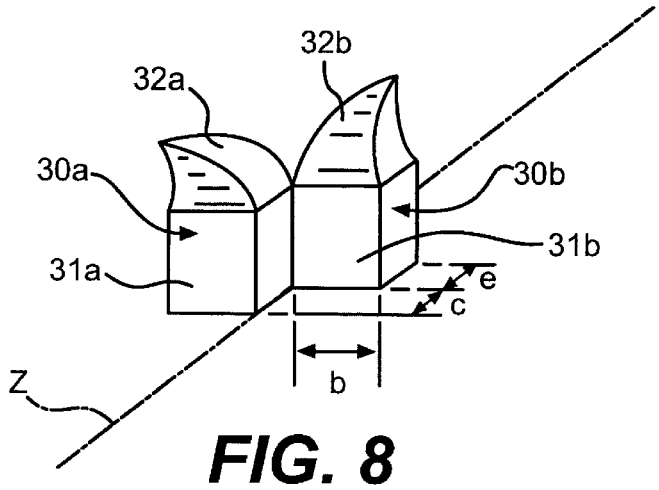
FIG. 8 is a perspective view of two consecutive teeth having free ends extending toward opposite ends of the application element according to an aspect of the invention.

In FIG. 8, the upper portions 32*a* and 32*b* are inclined forward and backward respectively. That is, the tooth in the series 30*a* has an upper portion 32*a* facing one end of the application element, namely the distal end, and the tooth in the series 30*b* has an upper portion 32*b* facing the opposite end of the application element, namely the proximal end. The respective ends toward which the tooth in each series faces may be reversed. That is, the upper portions 32*a* may face the proximal end of the application element and the upper portions 32*b* may face the distal end.

Figure 9:
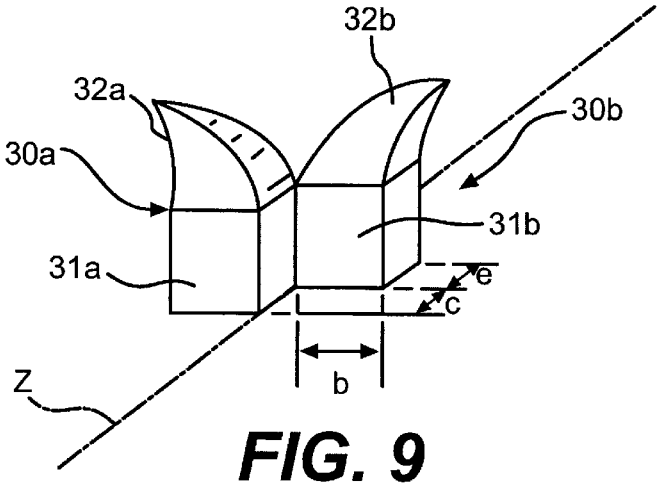
FIG. 9 is a perspective view of two consecutive teeth having free ends diverging away from one another according to an aspect of the invention.

In FIG. 9, the upper portions 32*a* and 32*b* are inclined respectively to the left and to the right when the comb is observed along its length. That is, the upper portions of the two consecutive teeth diverge away from each other or point outward when the application element is viewed along its length from the front.

Figure 10:
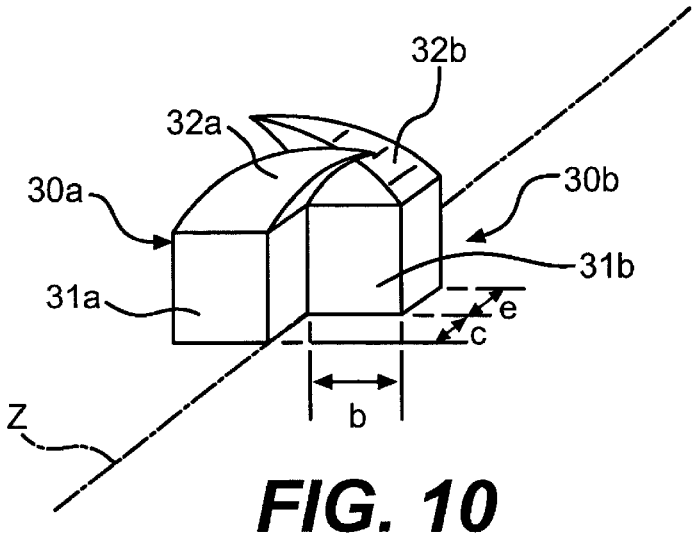
FIG. 10 is a perspective view of two consecutive teeth having free ends converging toward one another according to an aspect of the invention.

In FIG. 10, the upper portions 32*a* and 32*b* are inclined respectively to the right and to the left and may or may not cross when the application element is observed along its length. That is, the upper portions of the two consecutive teeth converge toward each other or face inward when the application element is viewed along its length from the front.

In an alternative form not shown in the drawings, the upper portions of the teeth are, in addition to being inclined to the left and to the right respectively, also inclined forward or backward respectively, or vice versa. Numerous other configurations and combinations of the upper portions of consecutive teeth also are contemplated and considered to be within the scope of the invention.

Figure 11:
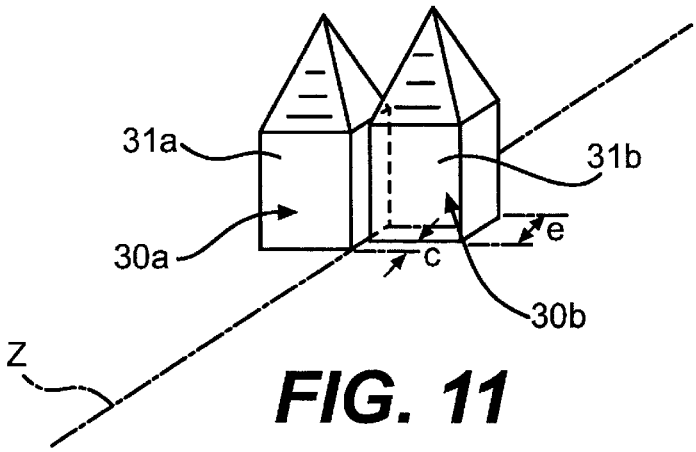
FIG. 11 is a perspective view of two consecutive teeth having overlapping faces extending substantially parallel to a longitudinal axis of the application element according to an aspect of the invention.

Contact between the roots of the teeth may not be restricted to one edge in common and the teeth may overlap further in the direction of the axis Z when the application element is observed from the side, i.e., in a direction parallel to the longitudinal axis Z of the application element, as depicted in FIG. 11. That is, adjacent faces of consecutive teeth disposed parallel to the longitudinal axis of the application element overlap each other.

Figure 12:
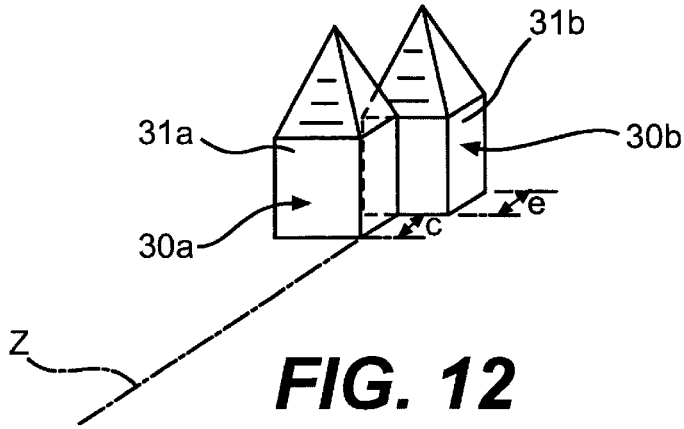
FIG. 12 is a perspective view of two consecutive teeth having overlapping faces extending substantially perpendicular to a longitudinal axis of the application element according to an aspect of the invention.

The teeth may alternatively overlap in a direction perpendicular to the axis Z, as illustrated in FIG. 12. That is a rear face and a front face, extending substantially perpendicular to the longitudinal axis of the application element, respectively, of two consecutive teeth may overlap one another.

Figure 13:
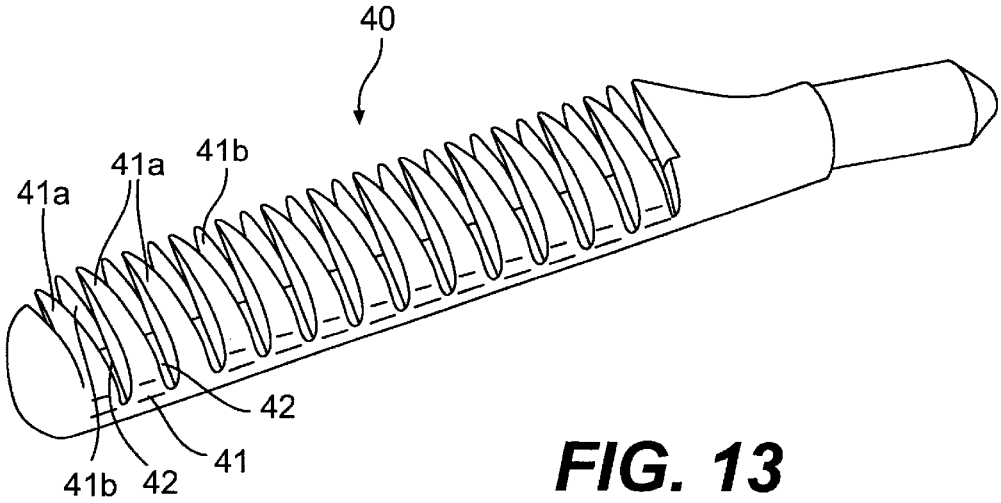
FIG. 13 is a perspective view of the application element of the applicator according to another aspect of the present invention.

FIG. 13 shows an application element 40 differing from the one depicted in FIG. 2 by the fact that roots of adjacent teeth disposed on the same side of the geometric separation surface join together to define grooves 42 formed in the continuation of the gap formed between adjacent teeth on the same side of the geometric separation surface. These grooves are capable of holding the product to be applied, thus increasing the loading of the application element.

The application element 40 includes a row of consecutive teeth made up of a first series of teeth 41*a* and of a second series of teeth 41*b,* arranged so that they alternate on each side of a geometric separation surface S which in this instance is the mid-plane of the base portion 41. Consecutive teeth 41*a* and 41*b* also overlap along the longitudinal axis of the application element to a greater extent than the teeth of the application element of FIG. 2.

The application element is not restricted to a comb, as has been described thus far, and may include several rows of teeth essentially forming a brush.

The base portion of the application element may have a polygonal, for example triangular, cross section, with one row of teeth extending in the continuation of each side of the base, making it possible for the eyelashes to come into contact with the base portion to become laden with product at the time of application and then to gradually come into contact with the teeth to smooth the product over the eyelashes and separate the eyelashes.

Figure 14:
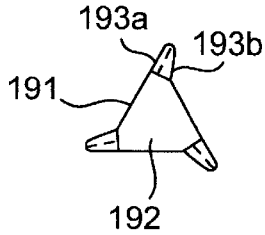
FIG. 14 is a cross-sectional view of an application element having a plurality of rows of teeth disposed in continuation of the sides of a polygonal base portion of the application element according to an aspect of the present invention.

By way of example, FIG. 14 shows an axial cross-section of an application element having a row of consecutive teeth 193*a,* 193*b* having at least the roots extending substantially in the continuation of a side 191 of a triangular base portion 192. As shown in the figure, a plurality of rows of teeth may be disposed on the base portion with each row of teeth having at least the roots extending in continuation of a different side of the polygonal base portion.

The teeth 193*a* and 193*b* may have an overall configuration similar to that of the application element 14 of FIGS. 1 to 4. It should also be noted that the base portion can have a variety of cross-sectional shapes. In fact, the base portion can be non-polygonal and the rows of teeth can extend substantially at a tangent to the perimeter of the base portion.

Figure 22:
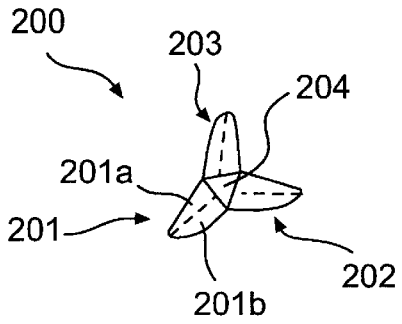
FIG. 22 is a cross-sectional view of an application element having a plurality of rows of teeth extending radially from a base portion of the application element according to an aspect of the present invention.

FIG. 22 is a view of a brush 200 including a base portion 204 of substantially triangular cross section and three rows of teeth 201, 202 and 203 arranged in a star configuration, each row extending radially from the base portion 204. Each row 201 to 203 includes teeth offset alternately on each side of a geometric separation surface, which, in this instance, is radial plane. Thus, the row 201 includes two series of alternating teeth 201*a* and 201*b* similar to the teeth 15*a* and 15*b* of the application element 14 of FIG. 2.

Figure 15:
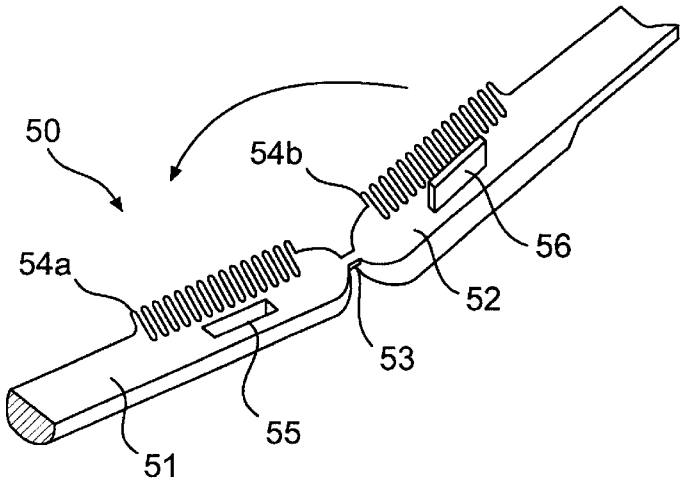
FIG. 15 is a perspective view of an application element having two parts connected together with a film hinge according to an aspect of the present invention.

The application element may be produced by assembling a number of parts. By way of example, FIG. 15 shows an application element 50 including two parts 51 and 52 that are molded with plastic and are connected to each other by a film hinge 53. A first part 51 includes a series of teeth 54*a* on its upper surface and a second 52 includes a series of teeth 54*b* on its upper surface. The consecutive teeth 54*a* and 54*b* when the part 51 is assembled with the part 52, i.e., when part 52 is folded over part 51, form a row of teeth located alternately on opposite sides of a geometric separation surface which in this instance includes the plane of contact of the parts 51 and 52.

The part 51 may include a housing 55 and the part 52 a fixing tab 56 configured to engage in the housing 55 so as to hold the parts 51 and 52 together. Other similar locking mechanisms may also be used to hold parts 51 and 52 together.

The teeth of the application element according to the invention may have front and rear faces disposed at an angle acute to, obtuse to, or perpendicular to the axis Z of the application element.

Figure 16:
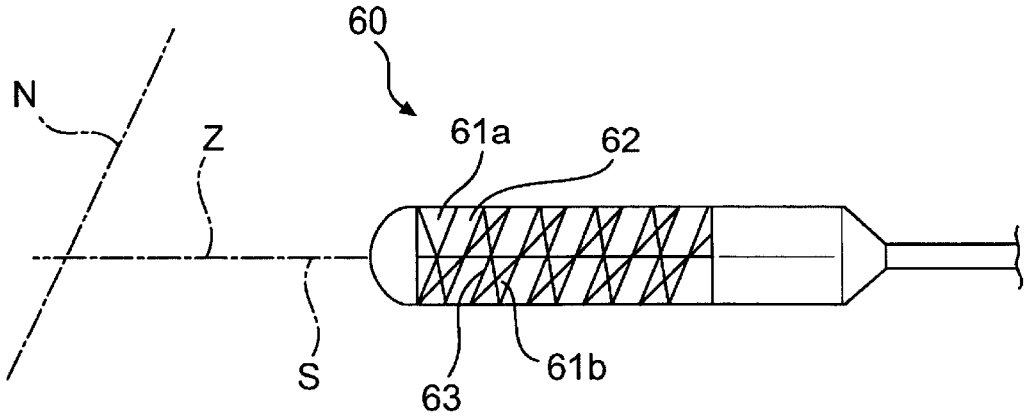
FIG. 16 is a partial top view of an applicator having teeth with faces disposed at an angle with respect to a longitudinal axis of the application element according to an aspect of the present invention.

FIG. 16 shows an application element 60 including a first series of teeth 61a and a second series of teeth 61*b* disposed alternately on opposite sides of a geometric separation surface S which, in the embodiment shown, is a mid-plane of symmetry of the base. Each of the teeth 61*a* or 61*b* includes lower portions, i.e., the roots, having respective front faces 62 and 63 which extend in a direction N, at an angle to the longitudinal axis Z of the application element. The lower portions of the teeth shown in FIG. 16 are in contact with each other. The lower portions of the teeth of one of the series need not extend in the same direction as the teeth of the other series.

Figure 17:
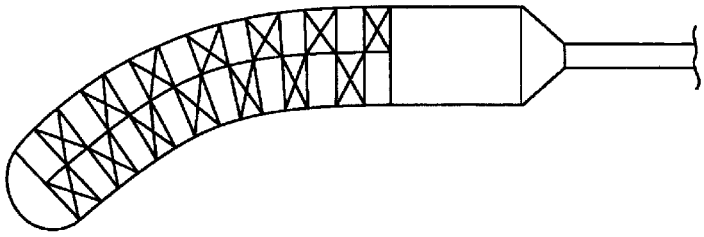
FIG. 17 is a partial top view of an applicator having an application element with a curved longitudinal axis according to an aspect of the present invention.

The base portion, and thus the application element, carrying the teeth has been depicted with a straight longitudinal axis in the foregoing embodiments. However, it would not be departing from the scope of the present invention if the base portion were to have a curved longitudinal axis, such as, for example, about an axis parallel to the geometric separation surface and substantially parallel to the longitudinal direction of the teeth, as depicted in FIG. 17. Alternatively, in certain embodiments, the base portion may have a longitudinal axis curved about an axis such as the axis Y of FIG. 1, perpendicular to the geometric separation surface S and substantially perpendicular to the longitudinal direction of the teeth, as illustrated in FIG. 18.

In FIG. 17, the geometric separation surface is a portion of a cylinder with a generatrix perpendicular to the plane of this figure and a directrix in the form of a portion of a circle. The geometric separation surface may be cylindrical, with a directrix consisting of a curve, as in FIG. 17, or a broken line, for example with a zigzag shape, according to an alternative form of the invention (not shown).

Figure 18:
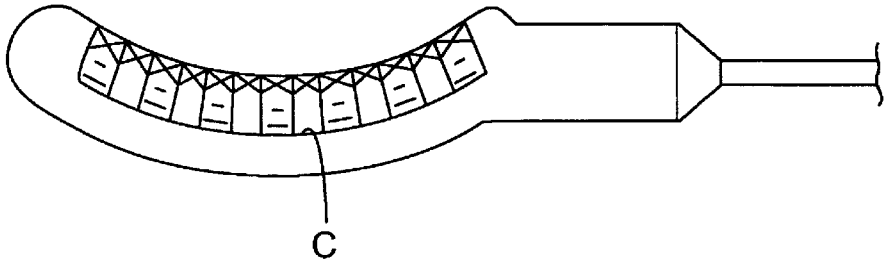
FIG. 18 is a partial side view of an applicator having an application element with a curved longitudinal axis different from the curved longitudinal axis of the application element of FIG. 17 according to yet another aspect of the invention.
Figure 19:
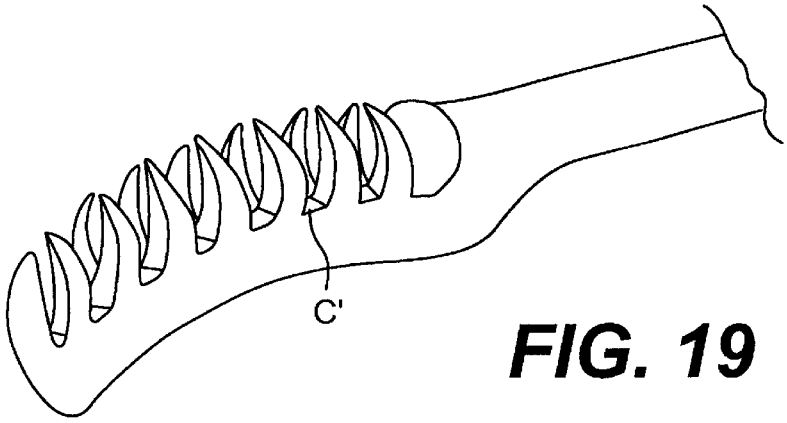
FIG. 19 is a partial side view of an applicator with a curved longitudinal axis consecutive teeth having convex and concave faces facing in opposite directions according to an aspect of the invention.

In FIG. 18, the base portion, and thus the application element, has a curved longitudinal axis with a concave surface C on which the teeth are disposed concave toward the tip of the teeth. In contrast, in the example of FIG. 19, the base portion has a curved longitudinal axis and convex surface C' on which the teeth are disposed. The first series of teeth of the consecutive teeth disposed on the application element in FIG. 19 have substantially concave front faces and substantially convex rear faces, while the second series of teeth have substantially convex front faces and concave rear faces.

A tooth located on one side of the geometric separation surface does not necessarily have the same overall shape as a tooth located on the other side of the geometric separation surface. For example, the application element may include a first series of teeth of one given configuration located on one side of the geometric separation surface and a second series of teeth located on the other side of the geometric separation surface alternating with the teeth of the first series and of a completely different configuration.

Figure 20:
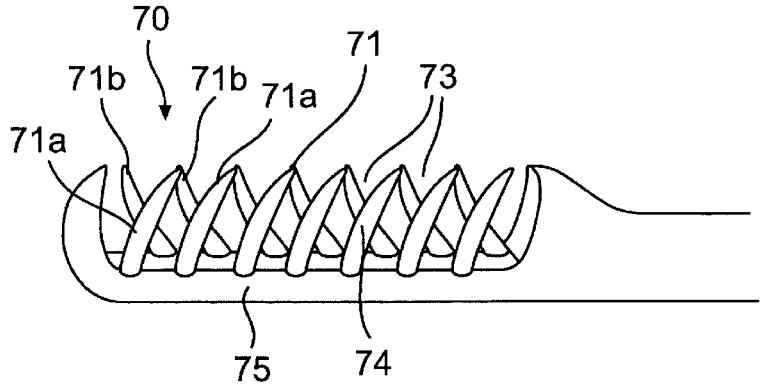
FIG. 20 is a partial side view of an applicator having an application element with consecutive teeth alternately inclined toward opposite ends of the application element according to an aspect of the present invention.

The application element 70 depicted in FIG. 20 includes a row of consecutive teeth 71 including a first series of teeth 71*a* and a second series of teeth 71*b*. The teeth 71*a* have portions disposed on one side of a geometric separation surface, which in the embodiment shown is a mid-plane of symmetry for the base portion, and the teeth 71*b* have portions disposed on the opposite side of this mid-plane.

In FIG. 20, the teeth 71*a* are inclined backward, i.e., toward a proximal end of the applicator, whereas the teeth

71*b* are inclined forward, i.e., toward a distal end of the applicator. The consecutive teeth 71*a* and 71*b* have portions that cross one another when the application element is observed from the side.

The teeth 71*a* and 71*b* define between them, at their upper portions, interstices 73 essentially in the form of notches. The bottoms 74 of the notches 73 are located a distance away from the top of the base portion 75. The teeth 71*a* and 71*b* may be joined together where they cross or may be substantially contiguous at that location.

Figure 21:
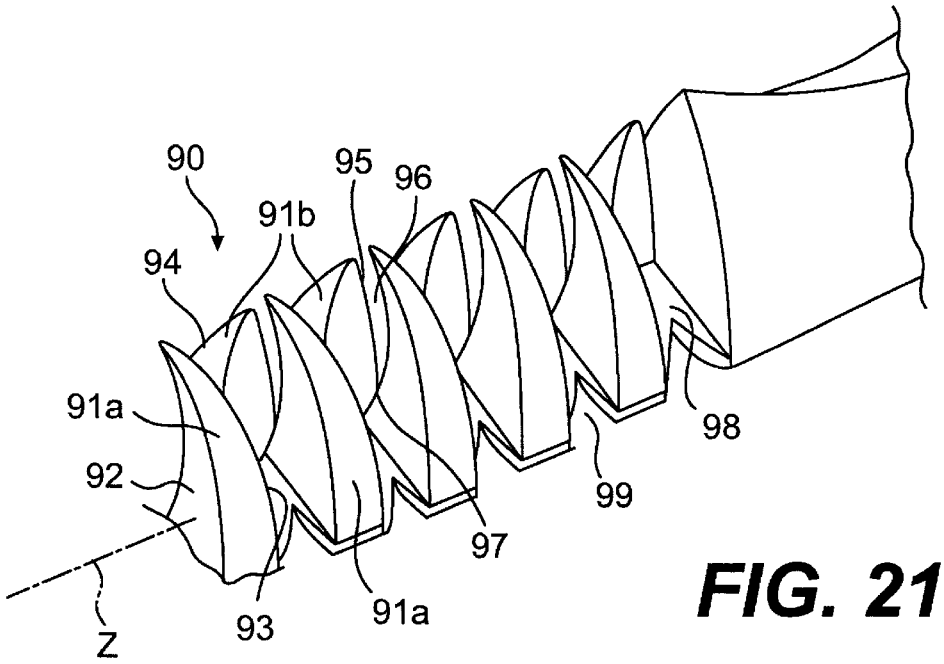
FIG. 21 is a detailed partial perspective view of an application element including teeth with convex, concave, and planar faces, and grooves formed on a base portion of the application element between adjacent teeth on the same side of the geometric separation surface.

FIG. 21 shows an application element 90 including a first series of teeth 91*a* and a second series of teeth 91*b*. The teeth 91*a* have root portions located on one side of a geometric separation surface and the teeth 91*b* have their root portions located on the opposite side of this geometric separation surface, the teeth 91*b* thus alternating with the teeth 91*a*. The applicator includes consecutive teeth 91*a* and 91*b* that have relatively wide root portions and significantly taper toward their free ends. When the application element 90 is observed from the side, the roots of consecutive teeth are substantially contiguous while the free ends of consecutive teeth are spaced relatively widely from each other.

The teeth 91*a* have a convex front face 92 facing a distal end of the application element and a convex rear face 93 facing a proximal end of the application element. The teeth 91*b* have a convex front face 94 and a rear face 95 which is substantially planar and perpendicular to the longitudinal axis Z of the application element 90.

The rear faces 95 of the teeth 91*b* and the front faces 92 of the teeth 91*a* form between them, when the application element 90 is observed from the side, notches 96, the bottoms 97 of which are a distance away from the base portion 98.

The application element shown in FIG. 21 also has grooves 99 on the base portion disposed between adjacent teeth on the same side of the geometric separation surface.

Figure 32:
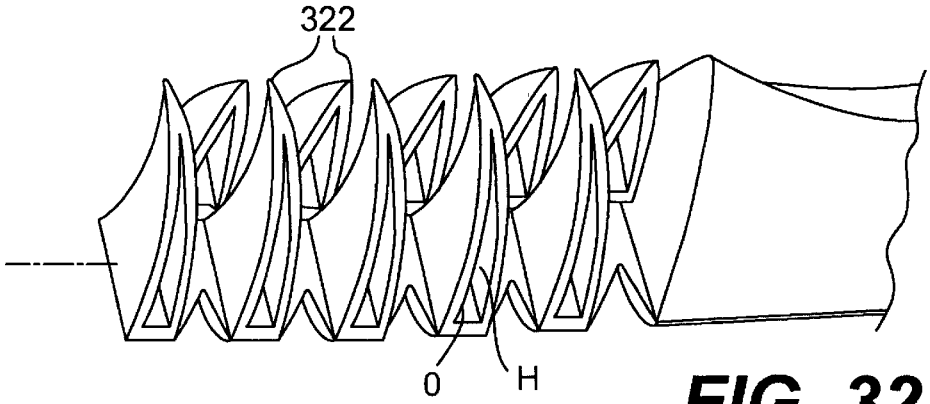
FIG. 32 is a close-up, perspective view of an application element having teeth with hollow portions extending along their sides according to an aspect of the present invention.
Figure 35:
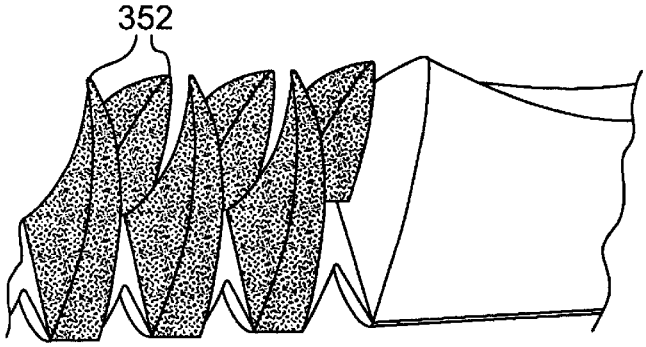
FIG. 35 is a partial perspective view of an applicator having flocked teeth.

FIGS. 32 and 35 show applicators of similar configuration to the applicator shown in FIG. 21. That is, the application element includes consecutive teeth having relatively wide root portions and significantly tapering toward their free ends. In FIG. 32, the teeth 322 have hollow portions H extending along a portion of their lengths. Openings O disposed on at least one side of each tooth lead to the hollow portion. The openings and hollow portions in the teeth permit the application element to hold an even greater amount of product. The applicator shown in FIG. 35 includes flocked teeth 352. The base portion of the application element on which the teeth are disposed also may be flocked. The flocking material either can be a coating placed on the teeth or can be placed directly in the material used to form the teeth.

Figure 23:
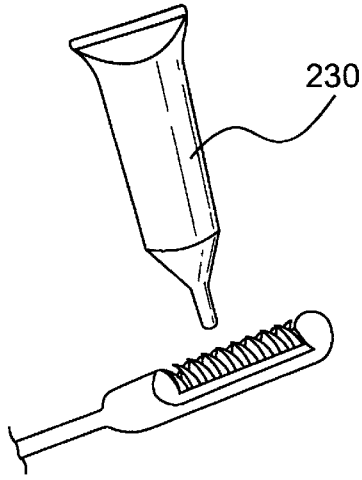
FIG. 23 is a perspective view of an embodiment of an applicator system according to the present invention wherein the product to be applied is dispensed onto the application member from a flexible tubular container.
Figure 24:
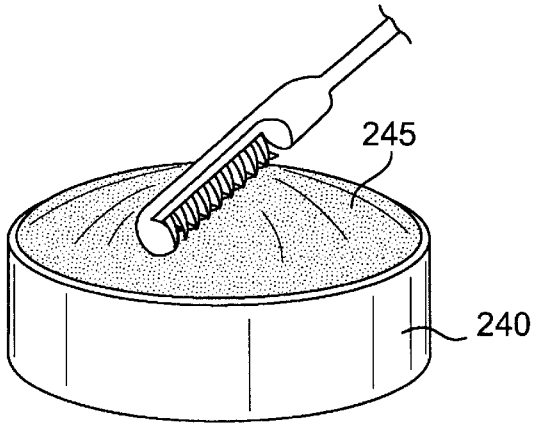
FIG. 24 is a perspective view of yet another embodiment of an applicator system according to the present invention wherein the product to be applied is in the form of a cake or powder.
Figure 25:
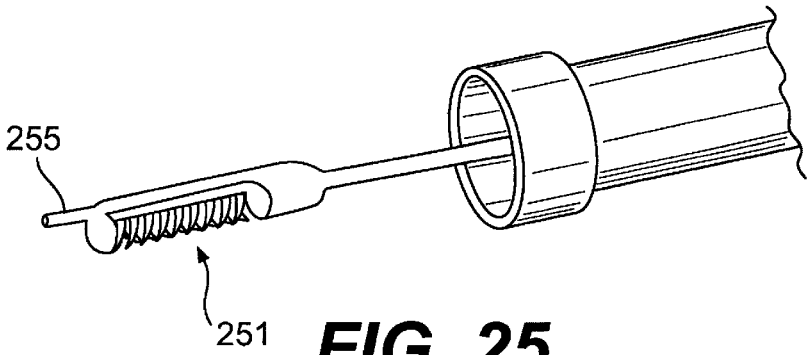
FIG. 25 is a perspective view of an applicator according to another aspect of the invention wherein the distal end of the application element includes a substantially pointed tip.
Figure 26A:
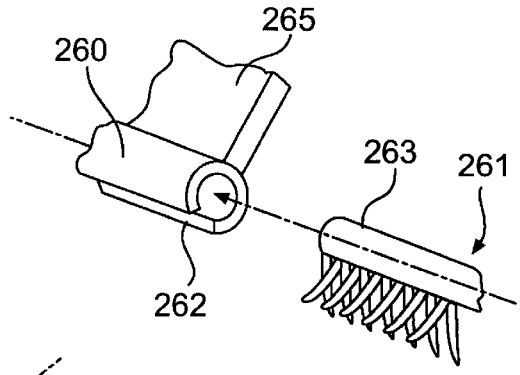
FIG. 26A is a partial close-up perspective view showing the application element prior to insertion in the housing of the applicator stem.
Figure 28:
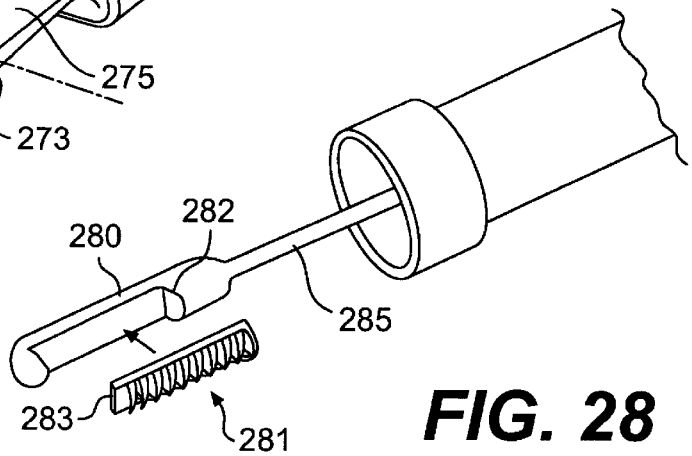
FIG. 28 is a perspective view of an applicator wherein the application element is removably engageable with a distal end portion of the stem according to another aspect of the present invention.

Alternatives to the applicator system discussed with respect to FIG. 1 are shown in FIGS. 23 and 24. FIG. 23 illustrates an applicator system in which the product is stored in a tube-like container 230. This tube preferably is made of a flexible material which when squeezed can dispense product onto the application element of the applicator device. Other dispensers also can be used to dispense the product onto the application element, such as a pump-type dispenser for example, and are considered within the scope of the invention. The applicator system shown in FIG. 24 includes a container 240 holding a solid cake of product 245. To load the application, the application element is run through this product 245. This solid cake preferably can be moistened and the application element run through the moistened part of the product to load the product onto the applicator device. Alternatively, the application element can be moistened and run through unmoistened product. For the embodiments shown in FIGS. 23 and 24, it is not necessary to equip the proximal end of the applicator device with a handle or a cap, as the applicator device is not stored in the container containing the product and does not close off such a container. Moreover, in these embodiments, the stem itself can be used as a handle. FIG. 25 illustrates yet another aspect of the applicator device of the present invention. The applicator device shown in FIG. 25 includes a pointed tip 255 extending from the distal end of the application element 251. Upon loading the application element 251 with product, the pointed tip 255 may also become loaded with product and can serve as a tool to line the eyes or as a picking device to pick through individual lashes. FIGS. 26, 26A, and 28 show embodiments of an applicator in which the application element is configured to be removably connected to the stem. The application element 261 shown in FIGS. 26 and 26A includes a base portion 263 on which a core and a row of teeth alternately disposed on opposite sides of the core are disposed. The base portion 263 is configured to be inserted into a connector 260 in the form of a housing or enclosure formed at a distal end portion of the applicator stem 265. FIG. 26A illustrates the inserting of the base portion 263 of the application element into the connector 260.

The housing 261 may define a slot 262 at the front or distal end portion of the stem to allow the passage of the roots and a portion of the core of the application element. Preferably the width of this slot is such that the roots of the teeth of the application element are clamped between opposite edges of the slot. This mounting allows the application element to be made of an elastomeric plastic and the stem 265 of a rigid or semirigid plastic.

As shown in FIGS. 26 and 26A, a longitudinal axis of the application element 261 is disposed substantially perpendicular to a longitudinal axis of the stem 265. The application element 261 is attached to a distal end portion of the stem 265 on a portion located between two ends of the application element.

FIG. 28 shows another embodiment of the applicator wherein the base portion 283 of the application element 281 can be removably connected to a connector housing 280 formed at a distal end portion of a stem 285. Again the housing 280 essentially defines a slot 282 with which the base portion of the application element is engageable. In contrast to the embodiment shown in FIGS. 26 and 26A, an end of the application element 281, as opposed to a portion between the ends, is connected to a distal end portion of the stem 285 when the application element is inserted into the connector 280. In FIG. 28, the longitudinal axis of the application element 281, once inserted into the connector 280, extends in substantially the same direction as the longitudinal axis of the stem 285. The application element may also extend at an angle to the stem, with an end of the application element still being connected to the distal end portion of the stem.

FIG. 27 shows an applicator similar in configuration to the applicator of FIG. 26. In the embodiment shown in FIG. 27, the base portion 273 is essentially formed as a single piece molded structure with the stem 275. Similarly, the teeth 276 can be molded as a single piece with the base portion 273 and stem 275.

Figure 29:
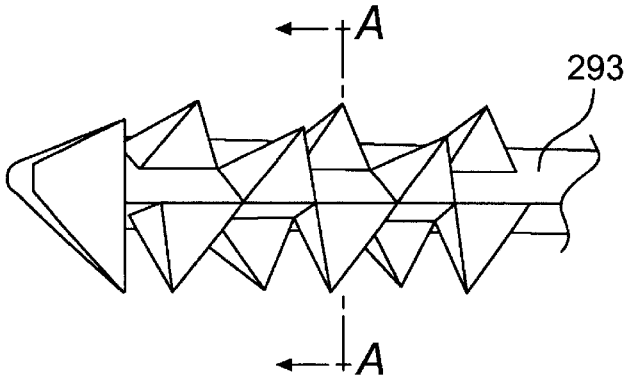
FIG. 29 is a partial perspective view of an application element having a polygonal base portion with a plurality of sides facing in different directions and a plurality of rows of consecutive teeth disposed respectively on each of the sides of the base portion according to an aspect of the present invention.

The application element shown in FIG. 29 includes a base portion 293 having a polygonal cross-section. The base portion 293 thus has a plurality of faces. A row of consecutive teeth alternately disposed on opposite sides of a geometric separation surface is disposed on each of the faces of the base portion 293. The geometric separation surface essentially corresponds to a mid-plane of the face on which each row is disposed. The width of each face of the base portion is approximately equal to the overall depth of the row of teeth. That is, the width of the base is essentially equal to the total depth of two consecutive teeth and thus the outer surfaces of each teeth are substantially flush with the edge of the face on which the teeth are disposed. Consecutive teeth in each row have portions substantially contiguous with one another and in the embodiment shown the consecutive teeth contact one another at a point on the roots of the teeth. The plurality of rows of consecutive teeth are disposed with respect to each other such that the series of teeth disposed on the edge of one face have substantially contiguous portions with the teeth disposed on the same edge of an adjacent face. As with the row of teeth disposed on the same face, the teeth on the same edge on adjacent faces have corners of their roots in contact with one another.

Figure 29A:
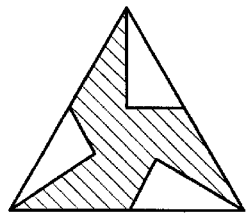
FIG. 29A is a cross-sectional view taken through line A—A in FIG. 29.

A cross-sectional view taken along line A—A of the application element of FIG. 29 is shown in FIG. 29A.

Figure 30:
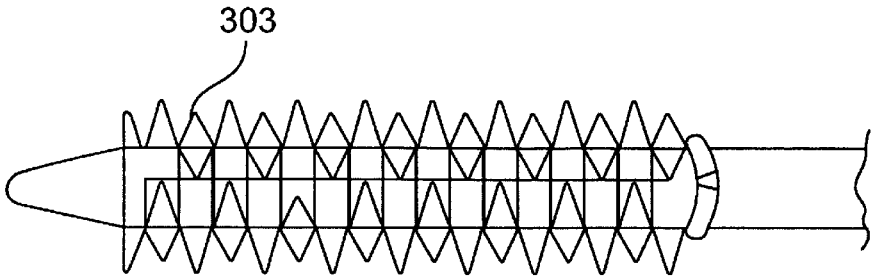
FIG. 30 is a partial perspective view of an application element having a non-polygonal base portion with a plurality of rows of consecutive teeth disposed at different angular positions around the base portion according to an aspect of the present invention.

FIG. 30 shows an embodiment of an application element similar to that shown in FIG. 29 with the exception that the base portion 303 has a non-polygonal cross-section. In the embodiment shown, the non-polygonal cross-section is substantially circular. A plurality of rows of teeth are disposed around the base portion 303 at angular positions such that adjacent rows are placed with respect to each other in a similar manner as was described with reference to the application element of FIG. 29. That is, the series of teeth in each row of consecutive teeth have corners of their roots in contact with the adjacent series of teeth in an adjacent row of consecutive teeth. Again, each row of teeth includes consecutive teeth alternately disposed on opposite sides of a geometric separation surface.

Figure 31:
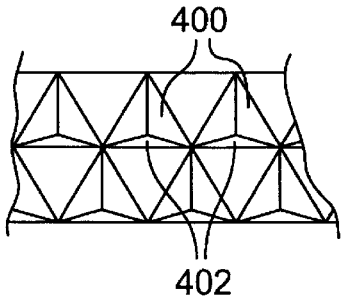
FIG. 31 is a partial top view of an application element having a row of consecutive teeth according to yet another aspect of the invention.

FIG. 31 shows a detailed top view of one possible configuration for a row of consecutive teeth according to an aspect of the invention. The row of consecutive substantially contiguous, alternately disposed teeth are disposed such that on at least one outer face of the row, the roots of adjacent teeth 400 are spaced from one another. In other words, at least one series of adjacent teeth 400 located on the same side of the geometric separation surface includes faces 402 facing toward a part of the application element located on an opposite side of the geometric separation surface, the faces 402 being disposed parallel to a longitudinal axis of the application element.

Figure 33:
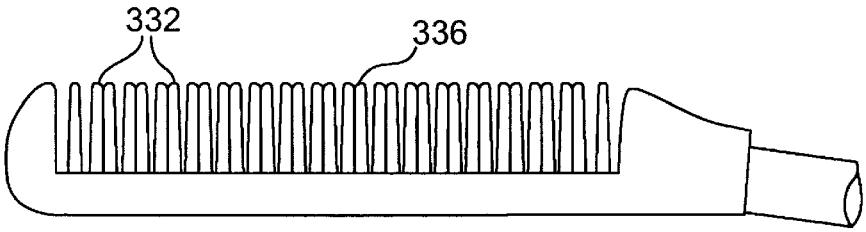
FIG. 33 is a partial perspective view of an applicator with an application member having pairs of consecutive alternately disposed teeth substantially contiguous with one another along a large part of their height.

In FIG. 33, an application element according to yet another aspect of the invention is shown. The application element includes a row of consecutive teeth alternately disposed at least partially on opposite sides of a geometric separation surface. The row of teeth is essentially in the form of pairs of consecutive teeth 332. Each tooth of the pair is disposed on an opposite side of the geometric separation surface and has a relatively large portion on along its length substantially contiguous with the other tooth of the pair. The free ends of the teeth of the pair of teeth form between them a small notch 336 capable of gripping the eyelashes during application of the product. The pairs of teeth are spaced from one another along the length of the application element.

Figure 34:
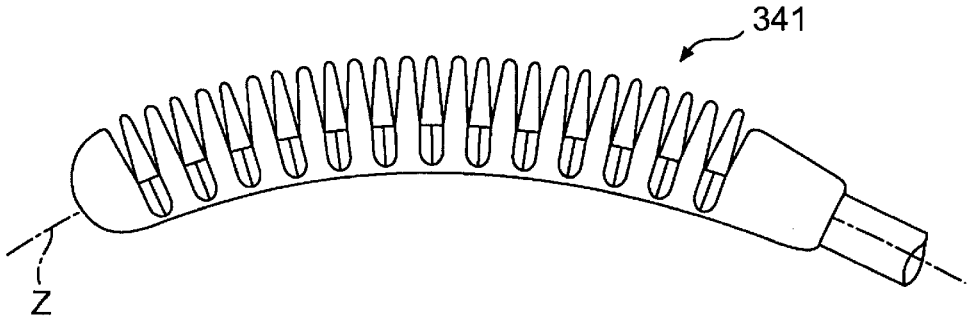
FIG. 34 is a partial perspective view of an applicator with a flexible application member having a substantially curved longitudinal axis according to yet another aspect of the invention.

As mentioned above, the application element may have a curved longitudinal axis Z with a convex surface on which the teeth are disposed, as shown in FIG. 34. Moreover, the application element may be made of a flexible material so that it is able to bend during application. Such a flexible application element also is illustrated in FIG. 34. The convex surface configuration causes the teeth to diverge away from each other, thus allowing a relatively large amount of product to be contained between adjacent teeth and consecutive teeth. Moreover, the applicator shown in FIG. 34 may achieve improved loading of the teeth with the product as the application element is withdrawn through a wiper. This is because the force of the wiper on the application element will tend to straighten the axis of the application element and cause the teeth to move toward each other, particularly toward a middle portion (along the length) of the application element. As the teeth move toward each other, product may be forced between the teeth toward the roots of the teeth and the base portion, again allowing the application element to hold a relatively large amount of product.

The invention is not restricted to the examples and embodiments just described. Rather, it is possible for at least some of the features of these examples and embodiments to be combined into one and the same applicator. In general, the particular features of each of the embodiments described may be combined, according to the type of product to be applied and the application effect desired.

For example, the teeth may have shapes other than those that have been described and the teeth on a particular application element or in a particular row need not have the same shape as each other. For example, the application element may include a row of consecutive teeth including a first and a second series of teeth alternately disposed as has been described where the teeth of the first series having a different shape than the teeth of the second series.

Moreover, teeth of the same series also may be made up of teeth with different shapes or even different heights. The teeth may, for example, have a height which varies according to an axial position along the length application element, for example a height which increases, decreases, decreases then increases or increases then decreases from one end of the application element to the other.

The application element may have a surface condition to increase the amount of product with which the application element becomes laden. For instance, the teeth, the base portion, and/or the core may include capillary grooves or flocking, over all or parts of their surface. An example of such flocking on the teeth is shown in FIG. 35.

The teeth may undergo a surface treatment by abrasion so as to form forks at the ends of the teeth, for example or may undergo a heat treatment to, for example, round their tips or form a bobble at their free end. The teeth thus become less aggressive toward the eyelashes.

The teeth, the base portion, and/or other parts of the application element may be coated with a gliding agent, such as a lacquer or Teflon, for example, to make them glide better along the eyelashes or, alternatively, to give them greater roughness. Such gliding agents may alternatively, or in addition, be added to the material used to form the teeth.

The application element, and especially the teeth, may also include active ingredients, such as preservatives, moisturizers, copper salts, magnetic particles, and other similar suitable materials, to be released into the product when the product is loaded onto the application element. These active ingredients can either be included in the material used to form the application element, or can be coated onto the application element, or both. In addition, products can be used to form or coat the teeth, base portion, and/or other parts of the application element to modify the surface tension of the application element upon contact with moisture.

The application element is preferably made by the injection-molding of plastic, but as an alternative, use may be made of methods for shaping material by compression, stamping or turning. The teeth may be made of a different material than that used to make the base portion or the portion of the application element on which they are disposed. Also, the application element and stem may be made of two different materials.

The base portion may also include grooves or reliefs configured to hold the product.

Although numerous configurations for the teeth and base portion are contemplated by the invention, in each of the embodiments described, preferably the length of a row of consecutive teeth will range from approximately 10 mm to approximately 45 mm, and more preferably from approximately 15 mm to approximately 28 mm, and even more preferably from approximately 20 mm to approximately 26 mm. The individual height of each tooth will preferably range from approximately 0.5 mm to approximately 15 mm, and more preferably from approximately 7 mm to approximately 13 mm. The number of teeth in a row of consecutive teeth will preferably range from approximately 6 to approximately 50, and more preferably from approximately 10 to approximately 35, and even more preferably approximately 15 to approximately 32.

It will be apparent to those skilled in the art that various modifications and variations can be made to the structure and methodology of the present invention without departing from the scope or spirit of the invention. Thus, it should be understood that the invention is not limited to the embodiments and examples discussed in the specification. Rather, the present invention is intended to cover modifications and variations of this invention, provided they fall within the scope of the following claims and their equivalents.

What is claimed is:

1. A system for applying a product to the eyelashes, comprising:

a container configured to contain the product; and an applicator including an application element including at least one row of consecutive teeth, said consecutive teeth being alternately disposed at least partially on opposite sides of a geometric separation surface, at least two consecutive teeth of the row having portions substantially contiguous with one another, and an interstice formed between said at least two consecutive teeth, wherein the applicator is configured to apply the product to the eyelashes.

2. The system of claim 1, wherein the substantially contiguous portions of the at least two consecutive teeth include the roots of the teeth.

3. The system of claim 2, wherein the roots contact one another.

4. The system of claim 2, wherein the roots overlap one another.

5. The system of claim 4, wherein the roots overlap one another when the application element is observed from the side.

6. The system of claim 1, wherein said substantially contiguous portions contact one another.

7. The system of claim 1, wherein the substantially contiguous portions overlap one another.

8. The system of claim 1, wherein at least two adjacent teeth disposed on the same side of the geometric separation surface have roots spaced apart from one another.

9. The system of claim 1, wherein the application element further includes a gap between roots of at least two adjacent teeth disposed on the same side of the geometric separation surface, the gap being at least equal to half a width of a tooth disposed on the opposite side of the geometric separation surface.

10. The system of claim 1, wherein the application element further comprises a base portion on which the teeth are disposed.

11. The system of claim 10, wherein the interstice is a notch and a bottom of the notch is spaced a distance from a top surface of the base portion.

12. The system of claim 11, wherein the distance is equal to at least approximately 0.2 mm.

13. The system of claim 10, wherein the teeth and the base portion are molded together as a single piece.

14. The system of claim 13, wherein the teeth and the base portion are molded together using plastic.

15. The system of claim 1, wherein a root of at least one tooth has a greater depth than width, the depth being measured in a direction perpendicular to a longitudinal axis of the application element and the width being measured in a direction parallel to the longitudinal axis.

16. The system of claim 1, wherein the teeth have a depth greater than a gap separating two adjacent teeth on the same side of the geometric separation surface, the depth being measured in a direction perpendicular to a length of the application element and the gap being measured along the length of the application element.

17. The system of claim 1, wherein the applicator further includes a stem, the application element being configured to be connected to the stem.

18. The system of claim 17, wherein the application element is molded as a single piece with the stem.

19. The system of claim 18, wherein the application element has two substantially opposite ends and one of the ends is connected to a distal end portion of the stem.

20. The system of claim 18, wherein the application element has two substantially opposite ends and a portion of the application element located between the two ends is connected to a distal end portion of the stem.

21. The system of claim 20, wherein the stem is substantially flat.

22. The system of claim 17, wherein the application element is removably connected to the stem.

23. The system of claim 22, wherein the stem includes a connector on a distal end portion of the stem, the application element being configured to engage with the connector.

24. The system of claim 23, wherein the connector defines a slot configured to receive the application element.

25. The system of claim 22, wherein the application element has two substantially opposite ends and one of the ends is connected to a distal end portion of the stem.

26. The system of claim 22, wherein the application element has two substantially opposite ends and a portion of the application element located between the two ends is connected to a distal end portion of the stem.

27. The system of claim 26, wherein the stem is substantially flat.

28. The system of claim 17, wherein the application element has a longitudinal axis that extends one of at an angle to and substantially parallel to a longitudinal axis of the stem when the application element is connected to the stem.

29. The system of claim 28, wherein the longitudinal axis of the application element extends perpendicular to the longitudinal axis of the stem.

30. The system as claimed in claim 1, further comprising a sealing member configured to sealably close the container.

31. The system of claim 30, wherein the applicator includes a stem and the stem includes the sealing member.

32. The system of claim 30, wherein the applicator includes a cap configured to sealably close an opening in the container, the cap including the sealing member.

33. The system of claim 17, wherein the application element is one of more flexible than the stem and less flexible than the stem.

34. The system of claim 1, wherein the teeth have a height ranging from approximately 0.5 mm to approximately 15 mm.

35. The system of claim 1, wherein the teeth have a height ranging from approximately 7 mm to approximately 13 mm.

36. The system of claim 11, wherein the teeth are disposed on a base portion, the teeth having a height of approximately 3 mm and the bottom of the notch being spaced a distance of approximately 2 mm from a top of the base portion.

37. The system of claim 1, wherein the teeth are connected to a base portion and the geometric separation surface is a mid-plane of the base portion.

38. The system of claim 1, wherein said geometric separation surface is a plane.

39. The system of claim 1, wherein said geometric separation surface is a parting line for a mold for the row of teeth.

40. The system of claim 1, wherein the geometric separation surface is non-planar.

41. The system of claim 1, wherein the geometric separation surface is twisted.

42. The system of claim 1, wherein the geometric separation surface is a cylindrical surface, the directrix of which is a curve or a broken line.

43. The system of claim 1, further comprising at least one groove formed between roots of adjacent teeth disposed on the same side of the geometric separation surface.

44. The system of claim 43, further comprising a base portion having two substantially opposite facing sides, consecutive teeth being disposed alternately on the substantially opposite facing sides of the base portion, said at least one groove being formed on one side of the base portion between adjacent teeth disposed on said one side of the base portion.

45. The system of claim 44, wherein the groove is in product flow communication with a volume defined by the two adjacent teeth and a third tooth disposed on the opposite side of the base portion and located intermediate the two adjacent teeth.

46. The system of claim 44, wherein a plurality of grooves are formed on one side of the base portion between adjacent teeth disposed on the same side of the base portion.

47. The system of claim 46, wherein the grooves are formed on both of the substantially opposite sides of the base portion between adjacent teeth on each of the sides of the base portion.

48. The system of claim 1, wherein roots of the teeth have faces disposed at an angle to a longitudinal axis of the application element.

49. The system of claim 48, wherein the angle is chosen from acute to, obtuse to, and perpendicular to the longitudinal axis of the application element.

50. The system of claim 48, wherein the teeth are disposed on a base portion and the angle is formed with a longitudinal axis of the base portion.

51. The system of claim 1, wherein at least one of the teeth as at least one face facing toward an end of the application element, the at least one face being disposed at an angle to a longitudinal axis of the application element when the application element is viewed from the side.

52. The system of claim 51, wherein the angle is chosen from perpendicular to, acute to, and obtuse to the longitudinal axis of the core.

53. The system of claim 51, wherein at least one tooth on one side of the geometric separation surface has a face facing toward an end of the application element disposed at an angle different to a face facing toward an end of the application element of at least one tooth on the other side of the geometric separation surface.

54. The system of claim 1, wherein at least one of the teeth includes an upper portion having a longitudinal axis coaxial with a root of said at least one tooth.

55. The system of claim 1, wherein the application element includes two opposite ends and the consecutive teeth include upper portions oriented alternately toward a first opposite end of the application element and a second opposite end of the application element.

56. The system of claim 1, wherein the at least two consecutive teeth have overlapping faces extending in a direction parallel to a length of the application element.

57. The system of claim 1, wherein the at least two consecutive teeth have overlapping faces extending in a direction perpendicular to a length of the application element.

58. The system of claim 1, wherein at least one of the consecutive teeth has at least one of a convex, a concave, and a planar face facing an end of the application element.

59. The system of claim 58, wherein the faces of the teeth disposed on one side of the geometric separation surface differ in configuration from the faces of the teeth disposed on the opposite side of the geometric separation surface.

60. The system of claim 1, wherein the at least two consecutive teeth have free ends diverging away from one another when the application element is viewed along its length.

61. The system of claim 1, wherein the at least two consecutive teeth have free ends converging toward one another when the application element is viewed along its length.

62. The system of claim 1, wherein the at least two consecutive teeth have free ends substantially parallel to one another when the application element is viewed along its length.

63. The system of claim 1, wherein the at least two consecutive teeth have free ends crossing one another when the application element is viewed along its length.

64. The system of claim 1 wherein the height of the teeth differ from one another.

65. The system of claim 1 wherein the application element has one row of teeth and essentially forms a comb.

66. The system of claim 1, wherein the application element includes a plurality of rows of teeth and essentially forms a brush.

67. The system of claim 66, wherein the rows of teeth are disposed at differing angular positions around a base portion of the application element.

68. The system of claim 67, wherein the base portion has a polygonal cross-section and at least one row of teeth extends substantially in continuation from a side of said base portion.

69. The system of claim 67, wherein the base portion has a non-polygonal cross section and at least one row of teeth extends substantially at a tangent to the base portion.

70. The system of claim 67, wherein at least one of the rows of teeth extends substantially radially from said base portion.

71. The system of claim 1, wherein the teeth are disposed on a base portion having a polygonal cross-section and the row of teeth extends substantially in continuation from a side of said base portion.

72. The system of claim 1, wherein the teeth are disposed on a base portion having a non-polygonal cross-section and the row of teeth extends substantially at a tangent to the base portion.

73. The system of claim 1, wherein the row of teeth are disposed on a base portion of the application element, the row extending substantially radially from the base portion.

74. The system of claim 73, wherein there are a plurality of rows of teeth, each row extending substantially radially from the base portion and at different angular positions with respect to a longitudinal axis of the base portion.

75. The system of claim 73, wherein the base portion has a cross-section chosen from polygonal and non-polygonal.

76. The system of claim 1, wherein the application element includes two parts connected to each other with a film hinge.

77. The system of claim 76, wherein a series of teeth are disposed along an upper surface of each of the two parts of the application element, said row of teeth being formed by folding the two parts at the film hinge such that the upper surfaces of the two parts are opposing each other.

78. The system of claim 1, wherein the product is contained in the container and the product is a cosmetic product.

79. The system of claim 78, wherein the cosmetic product is mascara.

80. The system of claim 1, further comprising a wiper configured to remove excess product from the teeth when the applicator is removed from the container.

81. The system of claim 80, wherein the wiper is deformable.

82. The system of claim 80, wherein the wiper is chosen from a block of foam and an elastomeric lip.

83. The system of claim 1, wherein a plurality of consecutive teeth have portions substantially contiguous with one another and a plurality of interstices are formed between the plurality of consecutive teeth having substantially contiguous portions.

84. An applicator for applying a product to the eyelashes, comprising:

a stem; and an application element disposed on an end of the stem, the application element including at least one row of consecutive teeth alternately offset at least partially on opposite sides of a geometric separation surface, and at least two consecutive teeth of the row having portions substantially contiguous with one another, wherein the applicator is configured to apply the product to the eyelashes.

85. The applicator of claim 84, wherein at least two adjacent teeth offset on the same side of the separation surface are spaced apart from one another without touching.

86. The applicator of claim 84, wherein three consecutive teeth define a volume configured to contain a product to be applied.

87. The applicator of claim 86, wherein the volume includes a substantially open portion and a substantially closed portion.

88. The applicator of claim 87, wherein the substantially open portion is defined between two of the three consecutive teeth disposed on the same side of the geometric separation surface.

89. The applicator of claim 88, wherein the substantially closed portion is defined by one of the three consecutive teeth disposed on the opposite side of the geometric separation surface from the two of the three consecutive teeth disposed on the same side of the geometric separation surface.

90. The applicator of claim 84, wherein the teeth disposed on one side of the geometric separation surface are located at different positions along a length of the application element than the teeth disposed on the opposite side of the geometric separation surface.

91. The applicator of claim 84, wherein the substantially contiguous portions of the at least two consecutive teeth include roots of the at least two consecutive teeth.

92. The applicator of claim 84, wherein the substantially contiguous portions of the at least two consecutive teeth include upper portions of the at least two consecutive teeth.

93. The applicator of claim 84, wherein at least one notch is formed between the at least two consecutive teeth, the notch being disposed above the substantially contiguous portions of the teeth.

94. The applicator of claim 84, wherein a plurality of consecutive teeth have substantially contiguous portions.

95. The applicator of claim 94, wherein a plurality of interstices are formed between the plurality of consecutive teeth.

96. The applicator of claim 95, wherein the interstices are V-shaped notches disposed above the substantially contiguous portions of the teeth.

97. The applicator of claim 84, wherein the substantially contiguous portions are in contact with one another.

98. The applicator of claim 84, wherein the substantially contiguous portions overlap one another.

99. The applicator of claim 98, wherein the overlapping portions of the consecutive teeth include faces of the teeth extending in a plane substantially parallel to a length of the application element.

100. The applicator of claim 98, wherein the overlapping portions of the consecutive teeth include faces of the teeth extending in a plane substantially perpendicular to a length of the application element.

101. The applicator of claim 84, wherein a longitudinal axis of the application element is curved.

102. The applicator of claim 84, wherein the application element further comprises a base portion having a plurality of sides, said at least one row of teeth being disposed on one of the sides of the base portion.

103. The applicator of claim 102, wherein there are a plurality of rows of teeth, each row being disposed on a different side of the base portion.

104. The applicator of claim 84, wherein at least one of the teeth has a hollow portion.

105. The applicator of claim 104, wherein the hollow portion extends along at least a portion of the length of said at least one tooth.

106. The applicator of claim 104, wherein at least one side of the tooth has an opening leading to the hollow portion.

107. The applicator of claim 84, wherein at least one of the teeth is flocked.

108. The applicator of claim 84, wherein the application element is removably connected a distal end portion of the stem.

109. The applicator of claim 108, wherein the application element has two substantially opposite ends, one of the ends being connected to the stem.

110. The applicator of claim 108, wherein the application element has two substantially opposite ends and a portion located between the opposite ends being connected to the stem.

111. The applicator of claim 84, wherein the teeth have a height ranging from approximately 0.5 mm to approximately 15 mm.

112. The applicator of claim 84, wherein the teeth have a height ranging from approximately 7 mm to approximately 13 mm.

113. An applicator for applying a product to eyelashes, comprising:

a stem; and an application element disposed on an end of the stem, said application element including at least one row of consecutive teeth alternately disposed at least partially on opposite sides of a geometric separation surface, said consecutive teeth including roots, wherein a cross section of each of the roots of teeth located on one side of the geometric separation surface has one of a face and a tangent plane facing toward a portion of the application element located on an opposite side of said geometric separation surface, said one of a face and tangent plane being substantially parallel to a longitudinal axis of the application element, and at least two consecutive teeth of the row of teeth having portions substantially contiguous with one another, wherein the applicator is configured to apply the product to the eyelashes.

114. The applicator of claim 113, wherein three consecutive teeth define a volume.

115. The applicator of claim 114, wherein the volume has a substantially open portion and a substantially closed portion extending parallel to the geometric separation surface.

116. The applicator of claim 115, wherein the substantially open portion is defined between two of the three consecutive teeth disposed on the same side of the geometric separation surface.

117. The applicator of claim 116, wherein the substantially closed portion is defined by one of the three consecutive teeth disposed on the opposite side of the geometric separation surface.

118. The applicator of claim 114, wherein two of the three consecutive teeth which are disposed on a same side of the geometric separation surface are spaced apart from one another without contact.

119. The applicator of claim 118, wherein a ratio of the spacing between the two teeth on the same side of the separation surface and the width of a tooth on the opposite side of the separation surface disposed intermediate the two teeth ranges from approximately 0.2 to approximately 2.0.

120. The applicator of claim 114, wherein the application element includes a base portion on which the row of teeth is disposed and the volume is further defined by a part of the base portion.

121. The applicator of claim 113, wherein the teeth have a height ranging from approximately 0.5 mm to approximately 15 mm.

122. The applicator of claim 113, wherein the teeth have a height ranging from approximately 7 mm to approximately 13 mm.

123. An applicator for applying a product to eyelashes, comprising:

a stem; and an application element disposed on an end of the stem, the application element including at least one row of consecutive teeth alternately offset at least partially on opposite sides of a geometric separation surface, and at least three consecutive teeth of the row defining a volume having a substantially open portion facing in a direction away from the separation surface, wherein the applicator is configured to apply the product to the eyelashes.

124. The applicator of claim 123, wherein the open portion of the volume extends in a direction substantially parallel to the geometric separation surface.

125. The applicator of claim 123, wherein the application element includes a base portion on which the consecutive teeth are disposed, the volume being further defined by the base portion.

126. The applicator of claim 123, wherein the volume is on at least one side of the geometric separation surface.

127. The applicator of claim 123, wherein the volume further includes a substantially closed portion extending in a direction substantially parallel to the geometric separation surface.

128. The applicator of claim 127, wherein the geometric separation surface is between the substantially closed portion and the substantially open portion.

129. The applicator of claim 127, wherein the open portion is defined between two of the three consecutive teeth offset on the same side of the geometric separation surface.

130. The applicator of claim 129, wherein the substantially closed portion is defined by one of the three consecutive teeth offset on the opposite side of the geometric separation surface.

131. The applicator of claim 123, wherein at least two consecutive teeth of the three consecutive teeth have portions substantially contiguous with one another.

132. The applicator of claim 131, wherein the portions overlap one another.

133. The applicator of claim 131, wherein the portions are in contact with one another.

134. The applicator of claim 132, wherein the portions are faces of the teeth disposed in a plane substantially parallel to a length of the application element.

135. The applicator of claim 132, wherein the portions are faces of the teeth disposed in a plane substantially perpendicular to a length of the application element.

136. The applicator of claim 123, wherein the application element includes a plurality of volumes defined by three consecutive teeth.

137. The applicator of claim 136, wherein a plurality of consecutive teeth have portions substantially contiguous with one another.

138. The applicator of claim 131, wherein at least one interstice is defined between the at least two consecutive teeth.

139. The applicator of claim 138, wherein the interstice includes a V-shaped notch and a bottom of the notch is disposed above the substantially contiguous portions of the at least two consecutive teeth.

140. The applicator of claim 137, wherein a plurality of interstices are defined between the plurality of consecutive teeth having substantially contiguous portions.

141. The applicator of claim 140, wherein the interstices include V-shaped notches and the bottoms of the notches are disposed above the substantially contiguous portions of the plurality of consecutive teeth.

142. The applicator of claim 123, wherein the teeth have a height ranging from approximately 0.5 mm to approximately 15 mm.

143. The applicator of claim 123, wherein the teeth have a height ranging from approximately 7 mm to approximately 13 mm.

144. The applicator of claim 123, wherein the volume is configured to hold a cosmetic product to be applied to the eyelashes.

145. The applicator of claim 144, wherein the cosmetic product is mascara.

146. An applicator system comprising:

the applicator of claim 84; and a container configured to contain the product.

147. The system of claim 146, further comprising:

a wiper configured to remove excess product from the teeth when the applicator is removed from the container.

148. The system of claim 147, wherein the wiper is deformable.

149. The system of claim 148, wherein the wiper is chosen from a block of foam and an elastomeric lip.

150. The system of claim 146, wherein the product is contained in the container and the product is a cosmetic product for the eyelashes.

151. The system of claim 150, wherein the product is mascara.

152. The system of claim 146, wherein the container includes an opening configured to permit passage of at least a part of the application element into the container, and wherein the system further comprises a cap at another end of the stem, the cap being configured to sealably close the opening.

153. An applicator system comprising:

the applicator of claim 113; and a container configured to contain the product.

154. The system of claim 153, further comprising:

a wiper configured to remove excess product from the teeth when the applicator is removed from the container.

155. The system of claim 154, wherein the wiper is deformable.

156. The system of claim 155, wherein the wiper is chosen from a block of foam and an elastomeric lip.

157. The system of claim 153, wherein the product is contained in the container and the product is a cosmetic product for the eyelashes.

158. The system of claim 157, wherein the product is mascara.

159. The system of claim 153, wherein the container includes an opening configured to permit passage of at least a part of the application element into the container, and wherein the system further comprises a cap at another end of the stem, the cap being configured to sealably close the opening.

160. An applicator system comprising:

the applicator of claim 123; and a container configured to contain the product.

161. The system of claim 160, further comprising:

a wiper configured to remove excess product from the teeth when the applicator is removed from the container.

162. The system of claim 161, wherein the wiper is deformable.

163. The system of claim 162, wherein the wiper is chosen from a block of foam and an elastomeric lip.

164. The system of claim 160, wherein the product is contained in the container and the product is a cosmetic product for the eyelashes.

165. The system of claim 164, wherein the product is mascara.

166. The system of claim 160, wherein the container includes an opening configured to permit passage of at least a part of the application element into the container, and wherein the system further comprises a cap at another end of the stem, the cap being configured to sealably close the opening.

167. A method for applying a product to eyelashes, comprising:

providing the system of claim 1;

loading a product on at least some of the teeth; and placing at least some of the teeth in contact with the eyelashes such that the product coats the eyelashes.

168. The method of claim 167, wherein the container contains the product and wherein the loading includes inserting the applicator into the container containing the product.

169. The method of claim 168, further comprising removing the applicator from the container and wiping excess product from the teeth.

170. The method of claim 167, wherein the loading includes dispensing the product from the container onto the teeth.

171. The method of claim 167, wherein the loading includes contacting the teeth with a solid cake of product.

172. The method of claim 171, further comprising moistening the solid cake of product.

173. The method of claim 167, further comprising gripping the eyelashes between consecutive teeth.

174. The method of claim 167, wherein the product is mascara.

175. The method of claim 174, wherein the mascara includes fibers, and wherein the method further comprises orienting the fibers with the teeth such that the fibers are substantially parallel to the eyelashes as the product is applied.

176. The method of claim 167, wherein the applicator further includes a stem, and wherein the method further comprises connecting a portion of the application element of the applicator to the stem of the applicator, the teeth being disposed on the application element.

177. The method of claim 176, further comprising selecting an application element from a plurality of application elements and connecting the application element to the stem.

178. A method for applying a product to eyelashes, comprising:

providing the applicator of claim 84;

loading a product on at least some of the teeth; and placing at least some of the teeth in contact with the eyelashes such that the product coats the eyelashes.

179. The method of claim 178, wherein the loading includes inserting the applicator into a container containing the product.

180. The method of claim 179, further comprising removing the applicator from the container and wiping excess product from the teeth.

181. The method of claim 178, wherein the loading includes dispensing the product from a container onto the teeth.

182. The method of claim 178, wherein the loading includes contacting the teeth with a solid cake of product.

183. The method of claim 182, further comprising moistening the solid cake of product.

184. The method of claim 178, further comprising gripping the eyelashes between consecutive teeth.

185. The method of claim 178, wherein the product is mascara.

186. The method of claim 185, wherein the mascara includes fibers, and wherein the method further comprises orienting the fibers with the teeth such that the fibers are substantially parallel to the eyelashes as the product is applied.

187. The method of claim 178, further comprising connecting a portion of the application element of the applicator to the stem of the applicator, the teeth being disposed on the application element.

188. The method of claim 187, further comprising selecting an application element from a plurality of application elements and connecting the application element to the stem.

189. A method for applying a product to eyelashes, comprising:

providing the applicator of claim 113;

loading a product on at least some of the teeth; and placing at least some of the teeth in contact with the eyelashes such that the product coats the eyelashes.

190. The method of claim 189, wherein the loading includes inserting the applicator into a container containing the product.

191. The method of claim 190, further comprising removing the applicator from the container and wiping excess product from the teeth.

192. The method of claim 189, wherein the loading includes dispensing the product from a container onto the teeth.

193. The method of claim 189, wherein the loading includes contacting the teeth with a solid cake of product.

194. The method of claim 193, further comprising moistening the solid cake of product.

195. The method of claim 189, further comprising gripping the eyelashes between consecutive teeth.

196. The method of claim 189, wherein the product is mascara.

197. The method of claim 196, wherein the mascara includes fibers, and wherein the method further comprises orienting the fibers with the teeth such that the fibers are substantially parallel to the eyelashes as the product is applied.

198. The method of claim 189, further comprising connecting a portion of the application element of the applicator to the stem of the applicator, the teeth being disposed on the application element.

199. The method of claim 198, further comprising selecting an application element from a plurality of application elements and connecting the application element to the stem.

200. A method for applying a product to eyelashes, comprising:

providing the applicator of claim 123;

loading a product on at least some of the teeth; and placing at least some of the teeth in contact with the eyelashes such that the product coats the eyelashes.

201. The method of claim 200, wherein the loading includes inserting the applicator into a container containing the product.

202. The method of claim 201, further comprising removing the applicator from the container and wiping excess product from the teeth.

203. The method of claim 200, wherein the loading includes dispensing the product from a container onto the teeth.

204. The method of claim 200, wherein the loading includes contacting the teeth with a solid cake of product.

205. The method of claim 204, further comprising moistening the solid cake of product.

206. The method of claim 200, further comprising gripping the eyelashes between consecutive teeth.

207. The method of claim 200, wherein the product is mascara.

208. The method of claim 207, wherein the mascara includes fibers, and wherein the method further comprises orienting the fibers with the teeth such that the fibers are substantially parallel to the eyelashes as the product is applied.

209. The method of claim 200, further comprising connecting a portion of the application element of the applicator to the stem of the applicator, the teeth being disposed on the application element.

210. The method of claim 209, further comprising selecting an application element from a plurality of application elements and connecting the application element to the stem.

211. The system of claim 1, wherein three consecutive teeth including the at least two consecutive teeth define at least part of a volume configured to contain the product.

212. The system of claim 43, wherein the groove is in product flow communication with a volume defined by the two adjacent teeth and a third tooth disposed on the opposite side of the geometric separation surface and located intermediate the two adjacent teeth when the application element is viewed from a side.

213. The system of claim 1, wherein adjacent teeth on at least one side of the geometric separation surface are spaced apart from one another without touching.

214. The system of claim 1, wherein the interstice is a substantially V-shaped notch.

215. The applicator of claim 113, wherein said cross-section is polygonal, and wherein a face of each of the roots faces said portion of the application element and is substantially parallel to said longitudinal axis.

216. The applicator of claim 113, wherein said cross-section is at least partially non-polygonal along an inner part of the roots, and wherein a tangent plane along each inner part faces said portion of the application element and is substantially parallel to said longitudinal axis.

217. The applicator of claim 1, wherein the substantially contiguous portions of the at least two consecutive teeth are configured to prevent an eyelash from moving freely between the portions.

218. The applicator of claim 1, wherein the substantially contiguous portions of the at least two consecutive teeth are configured to grip an eyelash passing between the portions.

219. The applicator of claim 84, wherein the substantially contiguous portions of the at least two consecutive teeth are configured to prevent an eyelash from moving freely between the portions.

220. The applicator of claim 84, wherein the substantially contiguous portions of the at least two consecutive teeth are configured to grip an eyelash passing between the portions.

221. The applicator of claim 113, wherein the substantially contiguous portions of the at least two consecutive teeth are configured to prevent an eyelash from moving freely between the portions.

222. The applicator of claim 113, wherein the substantially contiguous portions of the at least two consecutive teeth are configured to grip an eyelash passing between the portions.

223. The applicator of claim 131, wherein the substantially contiguous portions of the at least two consecutive teeth are configured to grip an eyelash passing between the portions.

224. The applicator of claim 131, wherein the substantially contiguous portions of the at least two consecutive teeth are configured to grip an eyelash passing between the portions.

* * * * *